US012478858B2

(12) United States Patent
Curley

(10) Patent No.: US 12,478,858 B2
(45) **Date of Patent: *Nov. 25, 2025**

(54) DEVICE AND METHOD FOR RESOLVING FLIPPED CARDS

(71) Applicant: Charles M. Curley, Cortland, NY (US)

(72) Inventor: Charles M. Curley, Cortland, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/928,080

(22) Filed: Oct. 27, 2024

(65) Prior Publication Data

US 2025/0058206 A1 Feb. 20, 2025

Related U.S. Application Data

(63) Continuation-in-part of application No. 18/446,139, filed on Aug. 8, 2023, now Pat. No. 12,194,371.

(51) Int. Cl.
*A63F 1/12* (2006.01)

(52) U.S. Cl.
CPC ..... *A63F 1/12* (2013.01); *A63F 2250/58* (2013.01)

(58) Field of Classification Search
CPC ..... A63F 1/12; A63F 1/14; A63F 2250/58
See application file for complete search history.

(56) References Cited

U.S. PATENT DOCUMENTS 1,885,276 A 11/1932 Mckay
2,815,214 A 12/1957 Hall
3,260,520 A 7/1966 Sugden
4,586,712 A 5/1986 Lorber
4,770,421 A 9/1988 Hoffman
5,683,085 A 11/1997 Johnson
5,722,893 A 3/1998 Hill
5,944,310 A 8/1999 Johnson
5,989,122 A 11/1999 Roblejo
6,267,248 B1 7/2001 Johnson
6,403,908 B2 6/2002 Stardust
6,629,894 B1 10/2003 Purton
6,651,982 B2 11/2003 Grauzer
6,659,460 B2 12/2003 Blaha
6,676,127 B2 1/2004 Johnson
7,036,818 B2 5/2006 Grauzer
7,677,565 B2 3/2010 Grauzer
7,753,373 B2 7/2010 Grauzer
7,764,836 B2 7/2010 Downs
8,381,918 B2 2/2013 Johnson
8,544,848 B2 10/2013 Blaha
8,556,263 B2 10/2013 Grauzer
8,807,348 B2 8/2014 Johnson
(Continued)

*Primary Examiner* — Michael D Dennis
(74) *Attorney, Agent, or Firm* — Chris Tanner; FYPA PLLC

(57) ABSTRACT

A compact card handling device for use in casinos possesses a card intake portal and two playing card discharge portals which are all accessible by a device operator. An optical recognition sensor cooperates with a microcontroller to interrogate the integrity of each card during an ongoing shuffling operation to discover unexpected cards, including unrecognized cards and flipped cards. Unexpected cards are immediately discharged to a dedicated portal for operator review. In the commonly encountered case of flipped cards, the operator may correct the orientation and re-insert a mis-oriented card into the device without interrupting the ongoing shuffling operation.

10 Claims, 18 Drawing Sheets

(56) References Cited

U.S. PATENT DOCUMENTS

| | | | | |
|---|---|---|---|---|
| 9,474,957 | B2 | 10/2016 | Haushalter | |
| 9,717,979 | B2 | 8/2017 | Grauzer | |
| 10,022,617 | B2 | 7/2018 | Stasson | |
| 10,532,272 | B2 | 1/2020 | Bourbour | |
| 10,668,361 | B2 | 6/2020 | Stasson | |
| 11,173,383 | B2 | 11/2021 | Krenn | |
| 11,338,194 | B2 | 5/2022 | Helgesen | |
| 11,376,489 | B2 | 7/2022 | Scheper | |
| 11,577,151 | B2 | 2/2023 | Helsen | |
| 11,898,837 | B2 | 2/2024 | Krenn | |
| 2008/0006997 | A1* | 1/2008 | Scheper | A63F 1/10 273/149 R |
| 2021/0354028 | A1 | 11/2021 | Krenn | |
| 2021/0379478 | A1* | 12/2021 | Hu | A63F 1/14 |
| 2022/0409985 | A1* | 12/2022 | Rynda | A63F 1/12 |

* cited by examiner (1997)

(1997)

(2003)

(2003)

DEVICE AND METHOD FOR RESOLVING FLIPPED CARDS

Continuation in Part from Parent U.S. application Ser. No. 18/446,139 (Card Handling Apparatus with Faulty Deck Rejection)

FIELD OF THE INVENTION

The present invention is related to the field of automatic electromechanical shuffling machines which are used by casinos to speed up the rate of play of dealer-hosted card games. More particularly, the invention relates to shuffling machines which utilize interrogation sensors to recognize marks and or indicia on playing cards for security purposes during shuffling operations for the purpose of maintaining card deck integrity.

BACKGROUND

Card games such as Blackjack are major attractions in casinos because they are relatively easy to play and allow wagering to various degrees of risk. A single deck or multiple decks of 52 playing cards are often used in these games, which must be periodically shuffled to effect randomness of the rank and suit of the individual cards within each deck. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play. In order to prevent down time, one group of decks is being shuffled while another group of decks is being utilized in an ongoing card game.

The prior art teaches that automatic shuffling machines have traditionally utilized image sensors to ensure the integrity of a card deck by sensing and tracking the identity of every card within a deck during the shuffling process. Contact Image Sensors (CIS) were invented in the 1970's for use in facsimile machines and have since been adopted for image sensing in various shuffling machines. Similarly, CMOS image sensors invented for use in digital cameras and scanners have also been adopted in the shuffler art. Numerous prior art references teach optical recognition devices that read identification marks and/or indica on each card to verify that the deck is complete and does not contain extraneous cards. Automatic shuffling machines verify that each and every card of each suit is included as required by the game being played, and that there exists no missing or extraneous cards resulting from machine malfunction or cheating.

For example, prior art U.S. Pat. No. 5,989,122 (Roblejo '122) appears to have pioneered the use of optical recognition sensors that are utilized to verify card deck composition. The Roblejo '122 embodiment is reproduced in FIG. 1 and discloses an automatic shuffler that utilizes an optical card reader 2044 which reads rank and suit of individual cards before they are moved from an unshuffled input stack 2042 to its randomizing mechanism. The role of the optical recognition device is to verify the composition and completeness of a set of playing cards prior to randomizing. Referring to FIG. 1, Roblejo '122 explains that an apparatus 2040 has a control means 2041, an input means for receiving playing cards onto an input stack holder 2042, and buffer means having a plurality of slots for temporarily holding cards, illustrated as a wheel 2043 (carousel) having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

> "It is an object of this invention to provide an apparatus and method for receiving cards, either from new decks or after the cards have been played, to shuffle the cards in a randomized order, and simultaneously to verify the accuracy of the set or sets of cards in the deck or decks. (Roblejo '122 col. 2; lines 22-27)
>
> "The means for reading indicia is preferably either a bar code reader, Video optical System, optical Scanner, reader of hologram information, or reader of magnetic indicia (Roblejo '122, col. 3; lines 65-67)".

Roblejo '122 also disclosed the use of the apparatus as a card deck verification apparatus, independent of its functions as a card shuffler.

> "In another aspect, the invention comprises a process comprising providing such an apparatus, feeding to the input means one or more cards either after they have been played in a game or from an unrandomized or unverified set, and manually retrieving a verified true set of cards from the stacking means." (Roblejo '122, col. 2; lines 53-58)

A myriad of subsequent prior art disclosures have described card shufflers which employ inspection stations. An audible or visual signal is usually made to alert the operator when a card fails the inspection criteria. However, much of the prior art is silent or indefinite regarding the destiny of a card that fails the inspection criteria and thereafter is entrapped within the apparatus. Moreover, such a faulty card by definition creates a faulty deck which is also entrapped within the apparatus. The destiny of the faulty card and the faulty deck is seldom addressed. This is also the case with Roblejo '122. Since Roblejo '122 does not teach an alternate card path, one of ordinary skill can only assume that the faulty card must be transported into one of the compartments of its carousel. Thereafter, the shuffling operation must be aborted and the carousel must be unloaded compartment by compartment to remove the faulty deck.

An excerpted illustration from prior art U.S. Pat. No. 6,629,894 (Purton '894) is shown in FIG. 2 and teaches alternative configurations of a digital camera (commonly known as a CMOS camera) arranged to inspect rank and suit of each card as a machine passes each card from one stack to another. Cards from a card stack 2000 on platform 2001 are fed from the bottom of the stack via a drive roll 2002 to pinch rolls 2007, which facilitate movement to card stack 2005. In one embodiment the cards of card stack 2000 are face down and a first camera 2003 reads the face of the cards within the card stack 2000 via a window 2004 of the platform 2001. Alternatively, digital camera 2006 can be mounted below the pinch rolls 2007 such that a face of the card can be read between the card stacks 2000 and 2005. In another embodiment, a camera 2006 is above the pinch rolls 2007 to read any cards that are face up between card stacks 2000 and 2005. Purton does not teach an alternate card path for those cards that fail its inspection criteria.

Purton '894 states:

> "The camera reads the face of the cards and using on board image processing, provides a data output which includes the suit and value portion of the face of the card. (Purton '894 col. 5; lines 67, col. 6; lines 1-3)
>
> "[A] a card stack may be supported by a platform through which a drive roller extends. This allows cards to be fed from the bottom of the stack. In this embodiment, the cards are placed face down. So that each card may be read by an upward looking digital camera, the platform is provided with a window or opening. In the alternative, the cards may be read between stacks, by a digital camera mounted above (with the cards face up) or below the pinch rollers (with the cards face down) which facilitate card transport between the two stacks." (Purton '894 col. 4; lines 60-67, col. 5; lines 1-3)

Prior art U.S. Pat. No. 6,403,908 (Stardust '908) teaches that it resolves flipped cards by physically flipping them within its apparatus. The disclosure explains the use of optical recognition for inspecting decks of playing cards by utilizing a scanner or digital camera to scan one card indicia at a time. Stardust '908 explains that images taken by cameras are supplied to a comparison circuit in the control processor which compares these images with stored images of a corresponding deck of cards to determine which card and what color card is detected by the camera or cameras. A digital camera or scanner can be used according to the disclosure.

Stardust '908 however fails to teach any physical structure or practiceable embodiments for its invention, but instead describes the apparatus abstractly in terms of block diagrams and symbol diagrams. The specification refers to FIG. 5 and FIG. 6 as the embodiments of the invention, but those figures are merely block diagrams. For example, Stardust '908 explains that flipped cards can be identified at its inspection station and thereafter flipped by a "digital imaging station/flipper 116". However, "digital imaging station/flipper 116" is shown only as a rectangle in a block diagram within FIG. 3 of the disclosure. An illustration of an embodiment of a card flipping mechanism which could be practiced by one of ordinary skill appears nowhere in the Stardust '908 disclosure. The card flipping mechanism is instead described indefinitely as a "means for flipping the playing card":

Mechanical means for flipping the playing card over to expose its opposite side could comprise any number of elements including, but not limited to, rotatable gripping prongs, or any one of a variety of rotating shelf members which pivot about a predetermined pivot point. (Stardust '908 col. 9; lines 46-50)

Prior art U.S. Pat. No. 6,676,127 (Johnson '127) discloses a collating apparatus for providing sorted and/or shuffled decks of playing cards which utilizes a CCD digital camera. Johnson '127 discloses that the camera is utilized to read the rank and suit of a deck of cards as each card passes by a scanning station. The camera described in Johnson '127 is model EB100/E-6 made by EverFocus® Electronics, which is a 492×510 pixel CMOS camera. Johnson '127 states:

"Thus, the device of the present invention is capable of accounting for all cards, and for producing an error signal when there are too few or too many cards. The device may also be equipped with a display that provides a visual indication of the particular cards missing or extra cards present, or the total card count." (Johnson '127 col. 4; lines 64-67, col. 5; lines 1-2)

U.S. Pat. No. 5,722,893 (Hill '893) discloses an optical sensor used to scan the rank and suit of a playing card as a dealer removes each playing card from a card dispensing shoe. Verification is achieved by comparing bit maps from the sensor to bit maps that are stored in memory. Hill '893 states:

"The present invention is directed to a shoe of the type described wherein the shoe has a card scanner which scans indicia on a playing card as the card moves along and out of a chute by manual direction by the dealer in the normal fashion. The scanner can be one of several different types of devices which will sense each card as it is moved downwardly and out of the from of the shoe." (Hill '893 col. 1; lines 41-46).

Even with optical card recognition and verification means, mechanical shuffling machines are not infallible, and suffer from various errors caused by several sources including cheating, lost cards, flipped cards, contamination, bent cards and covertly inserted cards. The verification is useful however, because it can prevent further play with a card deck that suffers from various illicit conditions. For example, prior art U.S. Pat. No. 11,376,489 (Scheper '489) discloses the problem of the shuffler encountering lost cards or flipped cards. Scheper '489 explains:

"If the shuffler stops shuffling for any reason, such as detecting extra or fewer cards in the set, or due to a shuffler malfunction, the game may be delayed, and revenue can be lost. Although it is desirable to stop a game that is using an invalid set of cards for security reasons, there are other reasons why a game might be delayed, such as when a shuffler malfunctions or the shuffler aborts the shuffle because of unreadable cards." (Scheper '489 col. 2; lines 57-67, col. 3; lines 1-2)

"Flipped cards and unrecognized cards typically cause the machine to abort the entire shuffle. Any time a shuffle is aborted, the game can be delayed, causing revenue loss to the casino." (Scheper '489 col. 3; lines 5-14)

The problem of flipped cards has been addressed in several prior art disclosures. U.S. Pat. No. 11,173,383 (Krenn '383) discloses the problems imposed by flipped cards in automatic shufflers, wherein the indicia face of the playing card faces upward rather than downward. Krenn '383 states:

"The card imaging device may be configured to identify whether a card face of the at least some of the playing cards are positioned in an expected orientation or whether the card face is in an unexpected orientation comprising one or more flipped cards." (Krenn '383 col. 1; lines 67, col. 2; lines 1-4)

"When placing the cards in the discard pile and/or infeed area of a shuffling device, the dealer should reorient the cards face-down such that the cards are all oriented in the same way. However, cards are frequently reinserted into the card shuffling devices in the wrong face orientation. In additional embodiments, a new deck of cards may include cards in an erroneous orientation. Regardless of the case, cards inserted with the wrong face orientation may cause delays or errors in the automatic shufflers. For example, a card inserted in the wrong face orientation may cause the shuffling devices to stop the shuffle and alert the dealer through an error message or to abort the shuffle entirely resulting in a delay for the associated gaming table." (Krenn '383 col. 5; lines 6-18)

Shufflers that utilize narrow combs or carousels are particularly problematic when encountering flipped cards because the deck that remains embedded within the shuffler after identifying an unreadable card may need to be purged. U.S. Pat. No. 10,668,361 (Stasson '361) describes an automatic card shuffler which ceases operation in the event of failed verification, thus delaying casino play, but does not explain the disposition or destiny of the remaining deck whose cards remain trapped within the elevator comb, which is shown in FIG. 3. Stasson '361 states:

"In the event that the verification process determines that the set of cards is incomplete or otherwise inaccurate, the card shuffler 100 may be configured not to dispense the shuffled cards and to display an error message or other signal to a user using the data output device 296 of the control system 280." (Stasson '361 col. 24; lines 57-62)

An exemplary shuffler disclosure is U.S. Pat. No. 8,381,918 (Johnson '918) which explains a carousel shuffler with an optical recognition device and a control panel that notifies the dealer when a faulty card is identified and may also reject individual faulty cards. Johnson '918 states:

"For example, a reject mechanism 8 may be associated with the sensor 15 to cause duplicate or oversupplied cards to be rejected before delivery by delivery carriages 18 to the magazine 20. The reject mechanism 8 may comprise an electromechanical device or air blast means coupled to the microprocessor 16. (Johnson '918 col. 5; lines 29-34)

"At the end of sorting, if any deck of cards is incomplete or over-supplied, a warning signal will be actuated in association with that deck to indicate the incomplete or oversupplied stack of cards. By actuating a liquid crystal display (LCD) or light-emitting diode (LED) display 28, this will indicate which card is missing or over-supplied and will also then indicate any other deck which is incomplete or over-supplied." (Johnson '918 col. 4; lines 46-52)

Johnson '918 distinguishes itself from others by the faulty card reject mechanism. However, Johnson '918 fails to provide an embodiment for its "electromechanical device or air blast means". The Johnson disclosure furthermore makes no attempt to explain the destiny of the resulting faulty card that is removed by the "electromechanical device or air blast means".

U.S. Pat. No. 11,898,837 (Krenn '837) discloses a highly complex compartment-type shuffler that utilizes a carousel as shown in FIG. 5. The apparatus can randomize a single 52-card deck of standard playing cards and includes a "defect detection system". The "defect detection system" includes an optical card recognition sensor that can identify rank and suit of each individual card, allowing the controller to thereafter utilize an output mechanism to divert faulty cards to a temporary storage compartment. The defective cards include cards whose "rank and suit cannot be determined, is marked, or otherwise adulterated". In one embodiment, the temporary storage compartment is referred to as "a vault".

Referring to FIG. 5, Krenn '837 discloses a device having an unshuffled card input area 830 for receiving a stack of unshuffled cards, a carousel 850, and card output mechanisms 866 and 868. Individual cards 870 are moved from the input area 830 past a "defect detection mechanism" 840 by feed rolls 860. Cards which are considered faulty are diverted to the vault 810 and non-faulty cards are directed into the carousel 850 where they are randomized by disgorging cards from the carousel compartments in a random order.

The "vault" 810 is a "removable rectangular prism and sized to hold bulk quantities of bent, folded, creased, kinked, and/or frayed cards in the compartment for subsequent removal, inspection, recycling, repurposing, or any combination of these". Although not specifically mentioned, one of ordinary skill will understand that the unreadable cards must also be diverted to the removeable vault. Nowhere in the disclosure do the inventors explain what action is taken by the apparatus after a faulty card has been detected and diverted to the isolation vault, leaving a partially shuffled deck trapped within the carousel. The process of diverting just one faulty card to an inaccessible compartment in itself creates an unusable deck which requires unloading from the carousel.

It can be observed that compartment-type shufflers (carousel or moving comb) require laborious, time-consuming activity to be unloaded when a faulty card is identified. In contrast, batch shufflers which handle discrete decks can be unloaded more quickly. U.S. Pat. No. 10,022,617 (Stasson '617) discloses a batch shuffler apparatus described as a "shuffling and verifying apparatus" which discloses an optical recognition device called an IDC ("image data-taking component") which is intended to read rank and suit of cards. Stasson '617 states:

"The card verification device of the present invention may be used to read and verify cards at various stages of card use, as the verification of cards is often desirable before, and after play of casino card games." (Stasson '617 col. 44; lines 8-11)

Nowhere in Stasson '617 do the inventors explain what action is taken by the apparatus when a faulty card has been detected. Since the apparatus has but one card deck output tray, it is clear that the faulty deck must be raised to that output tray and thereafter manually removed by the dealer when a faulty card is detected. Alternatively, a dealer in collusion with a cheating player may simply continue the card game with the faulty card.

U.S. Pat. No. 10,532,272 (Bourbour) also describes a batch shuffling apparatus. The specification explains:

"When combined with the ability to read card rank and suit, the device is capable of verifying that all cards are present and verifying the final order of the cards." (Bourbour '272 col. 17; lines 7-10)

"In one example of the invention, if cards are missing or extra cards are present, the display will indicate a misdeal and will automatically unload." (Bourbour '272 col. 17; lines 31-33)

Bourbour '272 did not disclose a means for the apparatus to automatically unload a faulty deck of cards. Instead, the apparatus is only capable of elevating the faulty deck to the card deck output tray where it must be manually removed by the dealer. Bourbour '272 thus suffers from the same limitation as the Stasson '617 described above. Since the elevator of the randomizer mechanism is used to hold the faulty deck in its output tray, the apparatus cannot continue the processing (shuffling & verification) of the deck until that faulty card is found and manually removed. The casino game may therefore be stopped until a new deck is inserted into the apparatus and thereafter shuffled, causing interruption of the casino game. Furthermore, that apparatus is subject to dealer-player collusion because the dealer is responsible for manually removing a faulty card.

Prior art U.S. Pat. No. 11,376,489 (Scheper '489) teaches a complex shuffling device which uses multiple elevators and a carousel as shown in FIG. 4. Scheper '489 teaches that unreadable cards are moved to a dedicated compartment within its carousel.

The playing card shuffling apparatus may be configured to receive the one or more unreadable playing cards in at least one dedicated compartment selected from the multiple compartments. (Scheper '489 col. 6; lines 36-39)

Referring to FIG. 4, Scheper '489 discloses a shuffling device that is embedded into a casino table and having a top surface 884 "that may be substantially co-planar with the table surface". Card intake area 890 is attached to an elevator 890 which moves cards from an upper loading position to a lower feeding position where cards are individually transported past a card imaging system within the transport mechanism 888. Cards are thereafter directed into a compartment of the carousel 886, where one particular compartment is dedicated for receiving unreadable cards. The unreadable cards in the dedicated carousel compartment are then unloaded after the properly shuffled and verified cards are unloaded, and can then be examined by the machine operator.

At the end of the card distribution process, if any unreadable cards are present in a designated compartment of the shuffling mechanism, those cards may be unloaded last at operation 2014 from the at least one designated compartment and combined with the set of cards in the card output. (Scheper '489 col. 31; lines 65-67, col. 32; lines 1-2)

The dealer may then remove any cards that do not belong in the deck, reorient the flipped cards and activate the shuffler to refeed the cards. (Scheper '489 col. 32; lines 12-15)

Although Scheper '489 teaches the separation and isolation of flipped cards, it does not provide a means for an operator to access those problematic cards such that the flipped cards can be remediated during an ongoing shuffling operation.

Recent U.S. Pat. No. 11,577,151 (Helsen '951) discloses a continuous shuffler that can move problematic cards in a reverse direction along its card path back to its card infeed tray after interrogation at an inspection station. The disclosure explains that the device will signal an error condition to the device operator and cease the ongoing randomizing operation. Card movement from the infeed tray is disabled and operation cannot commence until the operator takes action to inspect the problematic card and restart the operation.

In view of the various complex designs and problems explained above that insufficiently resolve reliability, a simple reliable mechanical shuffler is needed that can overcome the problems that can shut down a shuffler in the view of sustaining continuous game play when faced with the detection of an unreadable card, such as a flipped card. What is needed is a reliable, simple and compact card handling device and method that allows an operator to optionally remedy flipped cards on the fly without stopping or interrupting the ongoing shuffling operation, thus facilitating continuous play at a casino table with securely interrogated cards.

SUMMARY

One solution to the flipped card problem is to immediately discharge an unreadable card to a dedicated portal and continue the shuffling operation, optionally allowing the discharged card to be visually inspected by the operator while the shuffle operation is ongoing. In the often encountered case of flipped cards, the device operator may thereafter re-orient the card and re-insert it into the input tray while the shuffle is ongoing. Other unexpected cards that are isolated at the dedicated discharge portal may be treated in accordance to the rules that each casino may establish for the treatment of such rogue cards.

The device and method of an embodiment of the present invention utilizes an automatic shuffling apparatus which includes one card intake portal and two discharge portals. The first discharge portal receives play-ready stacks of cards for use in a subsequent card game. The second discharge portal receives a faulty card (unexpected or unreadable card) from within the device immediately after it passes an optical reading station. In the often encountered case that the card is unrecognized merely because it is flipped, the device operator may immediately re-insert the card into the input portal in a proper orientation without interrupting the ongoing shuffling operation, thereby avoiding the need to delay or abort the shuffling operation. In an alternate mode, the device may be utilized without shuffling to interrogate and verify the integrity of card decks.

The unique features of the secure card handling device and method described herein will become better understood with reference to the descriptions, drawings and claims which are presented below.

DETAILED DESCRIPTION OF PREFERRED EMBODIMENTS

Figure 1:
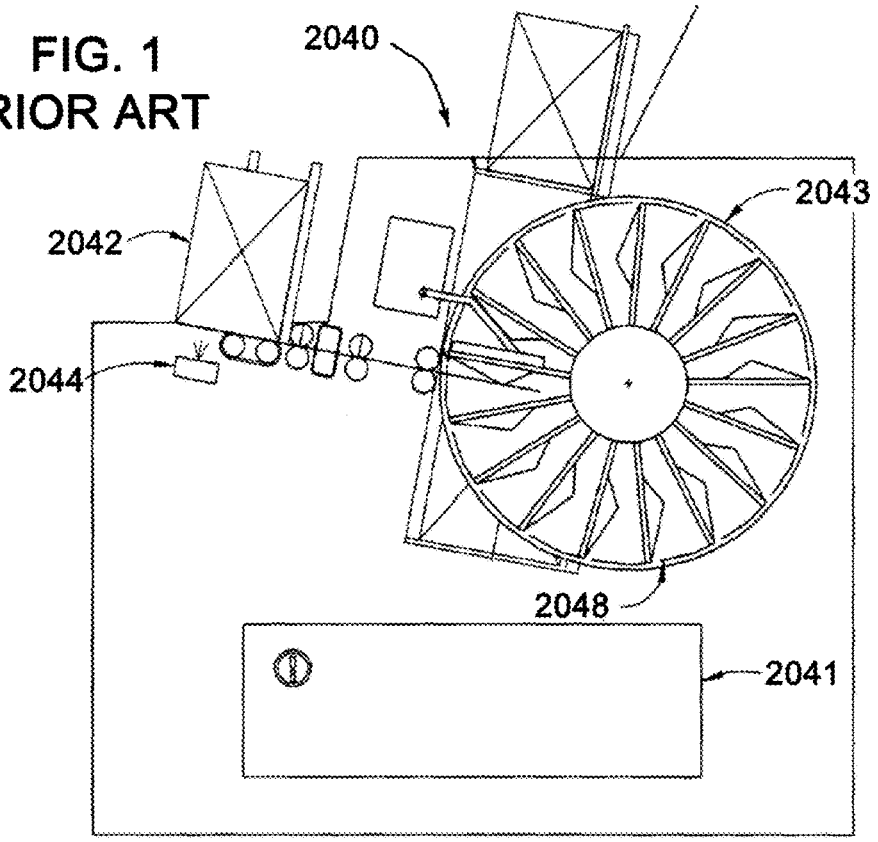
FIG. 1 PRIOR ART
FIG. 1 is a side elevation view from a prior art shuffling device disclosure having an optical inspection station.
Figure 2:
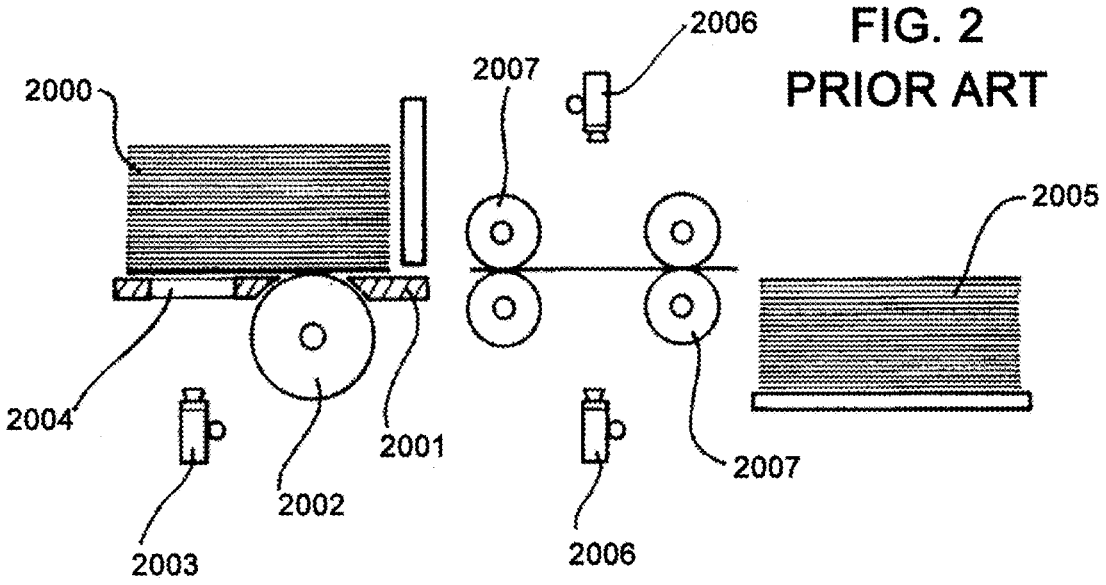
FIG. 2 PRIOR ART
FIG. 2 is a diagram from a prior art disclosure explaining positions for interrogation cameras.

A casino-grade card handling device for automatically shuffling and verifying one or more card decks simultaneously is described. The device can additionally be utilized in a non-shuffling mode to verify the integrity of each card within multiple decks of cards. A microcontroller utilizes an interrogation sensor to decide the destination of each card, whereupon appropriately identified cards are accumulated and moved to a first discharge portal and "faulty cards" are immediately discharged to a second discharge portal.

For purposes of this explanation, the term "unshuffled deck" is defined as a deck of cards in need of being shuffled (randomized) and verified. The term "shuffled deck" is defined as a deck of cards that has been transformed from an "unshuffled deck" into a shuffled (randomized) deck. The term "verification sensor" is defined as a sensor that can interrogate a playing card for interpretation by a microcontroller. In one form, a verification sensor may merely detect a mark or indicia on a card as it moves along a card path such that the microcontroller can confirm that the card belongs to a set. In more sophisticated forms, an interrogation sensor may take the form of a miniature camera that can photograph the indicia's of a passing card such that a microcontroller can interpret its suit and rank as is known in the art. The definition of a "fault criteria" is the criteria used by a microcontroller to determine the suitability of a card after interpreting the "verification sensor". In its simplest form, a "fault criteria" may be the number of cards that have passed the "verification" sensor within a given operational span.

The definition of an "unexpected card" is a card that is detectable by the interrogation sensor but does not belong to a set. An "unreadable card" is a card whose expected indicia or mark cannot be read by the interrogation sensor. Cards having indicia's obscured by food or drink residue are examples of unreadable cards. Cards that have been "flipped" such that their identifying indicia faces away from the sensor are further examples of unreadable cards. Flipped cards result from failures by a dealer to arrange each card in front-face to back-face orientation after sweeping spent cards from the table. Flipped cards are the most commonly encountered cause of unreadable card problems. "Faulty cards" include "unexpected cards" and "unreadable cards", including flipped cards Both "unexpected cards" and "unreadable cards" are deemed "faulty cards" which constitute fault criteria for triggering the microcontroller in the device described herein to immediately discharge such cards to the second discharge portal. A "verified group" is a group of one or more decks that have passed through the card handling device while avoiding the microcontroller's fault criteria after interrogation by the "verification sensor". Similarly, the microcontroller identifies a "play-ready group" as a card deck or plurality of card decks that have been shuffled and successfully avoided the microcontroller's "fault criteria" after interrogation by the "verification sensor".

It is understood that the "fault criteria" utilized by the microcontroller in the card handling device described herein can be adjusted according to the sophistication of its "verification sensor", where the sophistication of that sensor is a designer's choice from amongst the many types of optical interrogation sensors that are known in the art.

Figure 10:
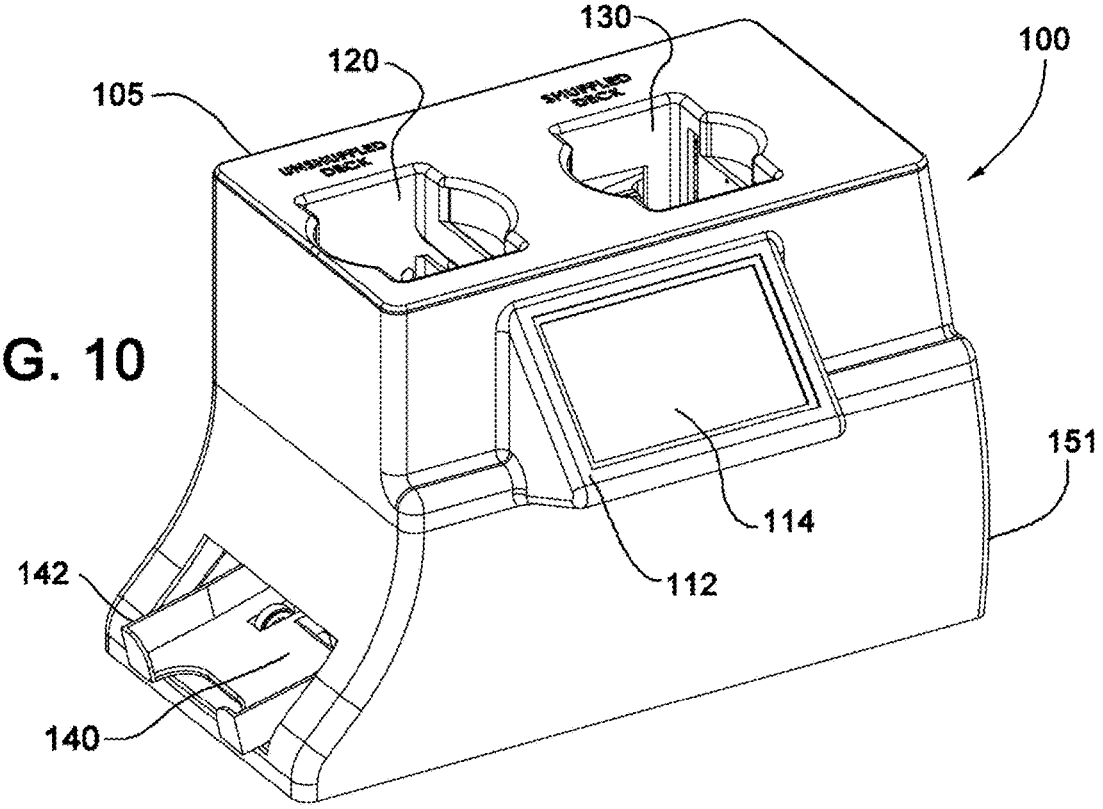
FIG. 10 is a perspective view of the first embodiment of the present invention as it would appear in a casino.

FIG. 10 illustrates a first embodiment of the card handling device disclosed herein as it would appear on a casino table. The card handling device 100 comprises a first intake portal 120 consisting of a recessed cavity for receiving a new or unshuffled deck of playing cards, and a first discharge portal consisting of a recessed cavity 130 for receiving a previously processed play-ready card group. A second discharge portal 140 is located on one lateral surface of the casing 151 and possesses an output tray 142 for receiving one card at a time from the internal randomizing (shuffling) mechanism.

Casing 151 supports a control panel 112 as shown in FIG. 10. The control panel 112 is positioned conveniently for a device operator on the exterior of the housing and comprises a touch screen 114. At least one microcontroller (not shown) controls the operation of the card handling device, including operation of the touch screen 114 which is used to both input commands and to display conditions within the card handling device, including fault conditions and progress conditions. Touch screen 114 is a small 5-inch touchscreen that is used to program the shuffler for various games. For size reference, a 5-inch touchscreen is slightly smaller than the touchscreens used in today's smallest mobile phones. The device operator may utilize the touch screen 114 to program the card handling device for the type of operation and the touchscreen will also indicate possible malfunctions and security issues to the device operator.

Figure 11:
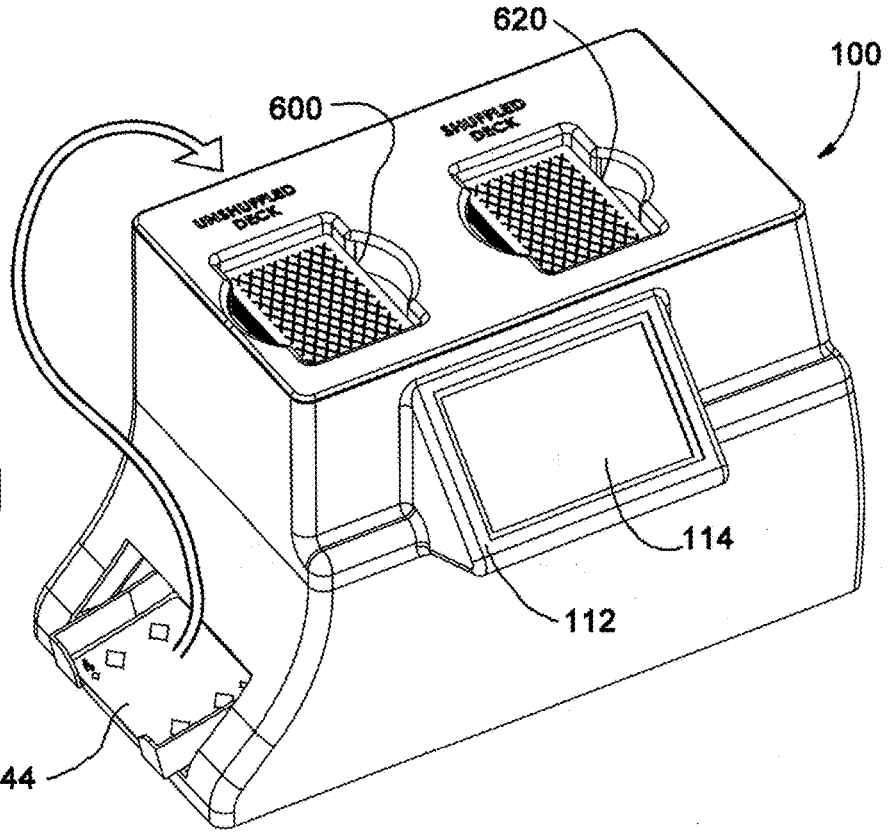
FIG. 11 is a perspective view of the first embodiment of the present invention visualizing the flipped card remediation method.

FIG. 11 illustrates the card handling device 100 as it appears during the shuffling operation immediately after detecting and discharging a flipped card. Cards from the unshuffled card stack 600 are being removed from the bottom of stack 600 and transported into a randomizing chamber. Non-faulty cards are being accumulated into stack 620 after they have been interrogated and randomized. A flipped card (four of diamonds) is shown residing in the output tray 142 while the shuffling operation continues. The device operator may reorient the flipped card and re-insert the properly oriented card into the portal 120 during the ongoing shuffling operation to prevent downtime.

Figure 12:
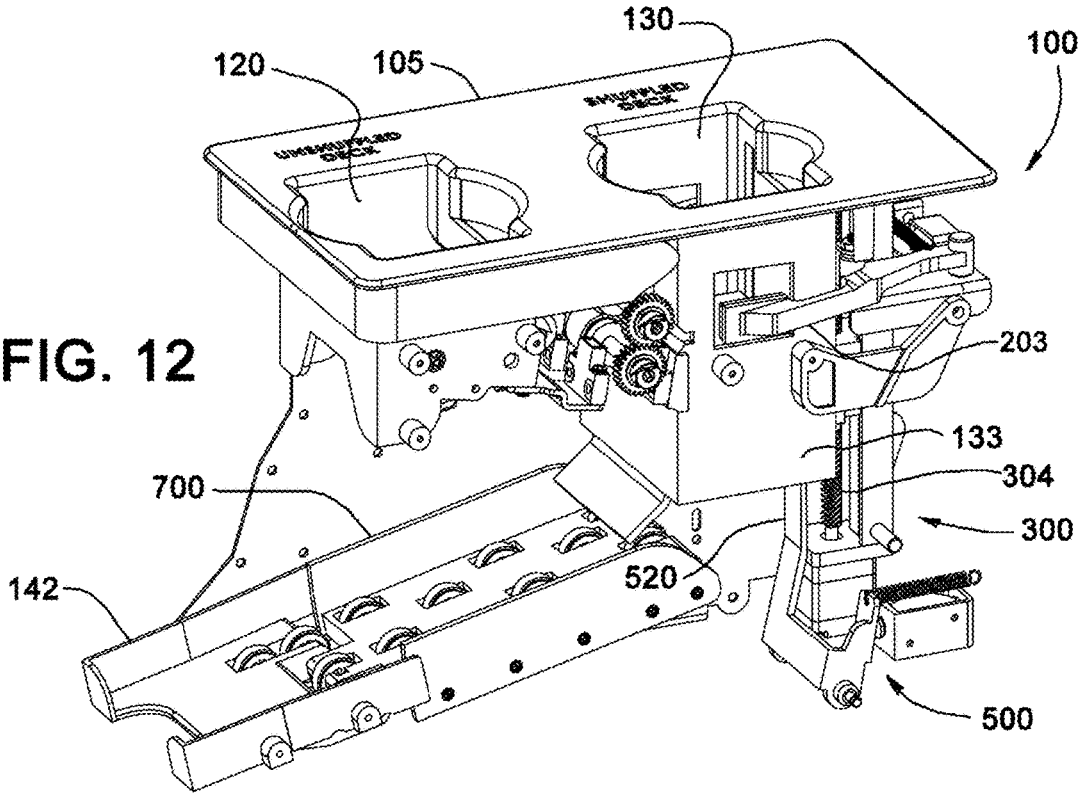
FIG. 12 is a perspective view of the card handling device herein showing the internal chambers and card paths with no cards present.

FIG. 12 shows an isometric view of the card handling device 100 with the casing 151 removed. The various components are supported by side frames, and one side frame has been removed from the view to reveal the internal chambers. An elevator mechanism 300 is located directly below the portal 130, and a discharge track 700 is shown sloping away from a lower portion of a randomizer chamber housing 133. In general, unshuffled cards are deposited into the input portal 120 and thereafter passed individually into the randomizing chamber within housing 133 where they are randomized. Play-ready card groups are then moved upward to the first discharge portal 130. Faulty cards are moved downward individually to a transfer mechanism where they are removed from the elevator to the discharge track 700. Individual faulty cards are moved to the output tray 142 of the second discharge portal 140 by inertia.

Figure 13:
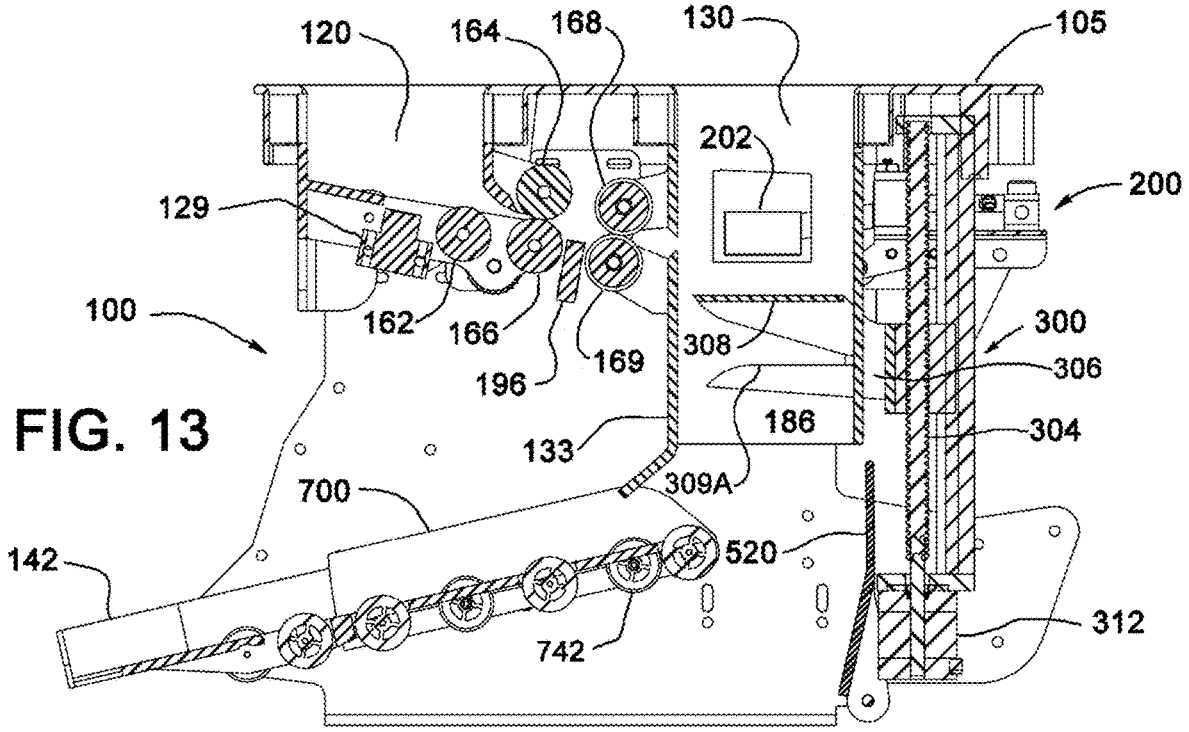
FIG. 13 is a side elevational section view which illustrates the basic layout of the card paths.

The anatomy of the card handling device 100 is briefly explained by the section view shown in FIG. 13 which is devoid of any cards. The unshuffled deck input portal 120 is shown near the top left of the view. Feed rolls 162, 166 and 164 are utilized to move individual cards from the unshuffled portal and past a verification sensor 196. Additional feed rolls 168 and 169 move individual cards into the randomizer chamber 186. The housing 133 possesses four walls which contain card stacks with slight clearance around the periphery, thus forming the randomizing chamber 186. After a deck or decks are randomized and successfully verified, the card stack will be supported upon elevator platform 308 which is moved vertically by the lead screw 304 in elevator assembly 300. The elevator platform 308 moves a play-ready group upward to the cavity 130. A faulty card is instead deposited onto surface 309A of the elevator and moved downward until being aligned with the path of arm 520 which is activated to eject a single faulty card onto the rolls 742 of discharge track 700 which is aligned with the axis of output tray 142.

Figure 14A:
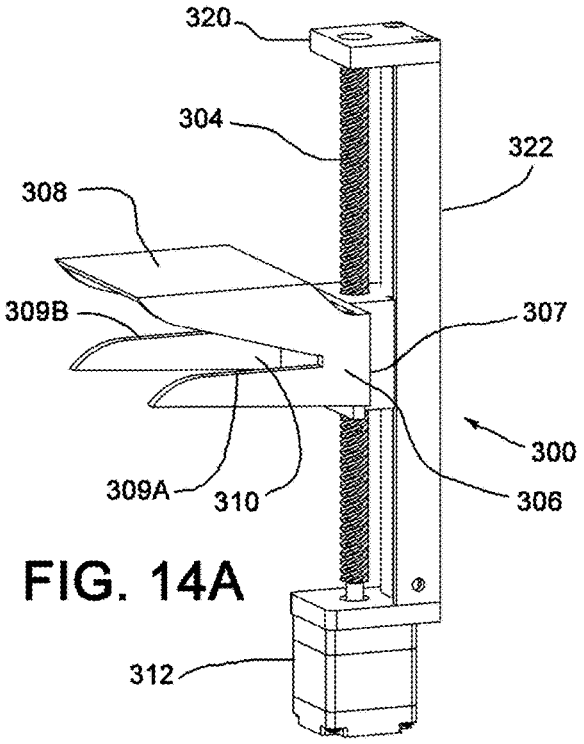
FIG. 14A is an isometric view of the elevator assembly of the first embodiment.
Figure 14B:
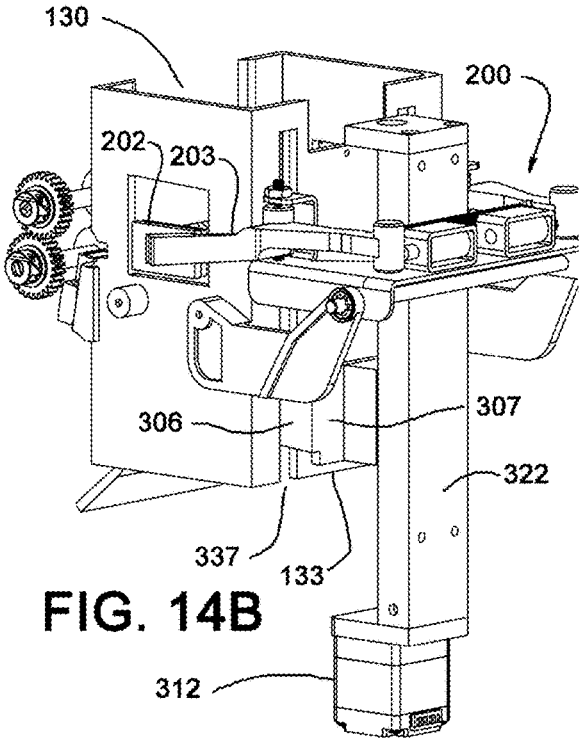
FIG. 14B is an isometric view of the randomization chamber housing of the first embodiment.

The randomizing chamber 186 in FIG. 13 possesses an elevator carriage 307 which is configured with two supports for transporting 1) card stacks and 2) a single card which has been identified as faulty. The structure of the elevator assembly 300 and its driving means is shown in FIG. 14. The elevator assembly 300 has an injection molded plastic elevator carriage 307 which compromises a first card support and a second card support which are separated by a slot 310. The first card support is configured as a platform 308 which is designed to support a stack of cards. The second card support is configured as a fork having two arms 309A and 309B which are designed to carry a single card. The elevator carriage 307 moves vertically by motion of a lead screw 304 which is driven by step motor 312. The elevator platform 308 supports card stacks as they are moved vertically within the randomizing chamber 186 while the support arms 309A and 309B are designed to support a single faulty card. As shown in FIGS. 14A and 14B, the platform 308 and the arms 309A, 309B are supported by a section 306 which penetrates the randomizing chamber 186 through access slots 337 in the chamber wall 133 of the randomizing chamber 186, such that the elevator supports may move freely in a direction parallel to the chamber walls.

Figure 15A:
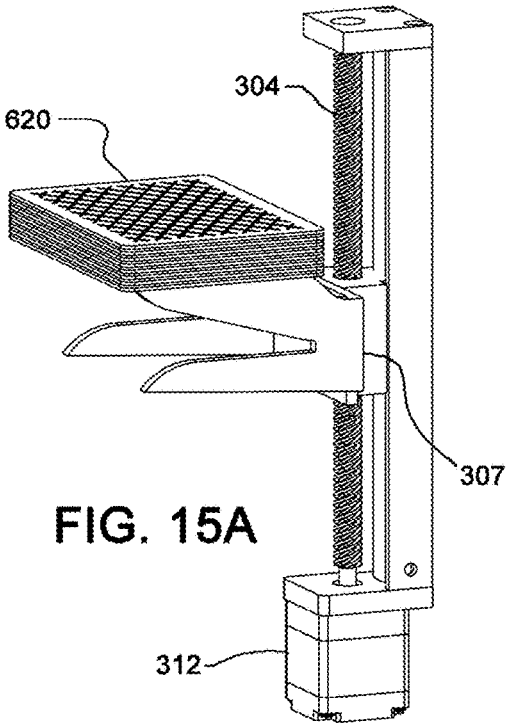
FIG. 15A is an isometric view of the elevator assembly of the first embodiment supporting a stack of cards.
Figure 15B:
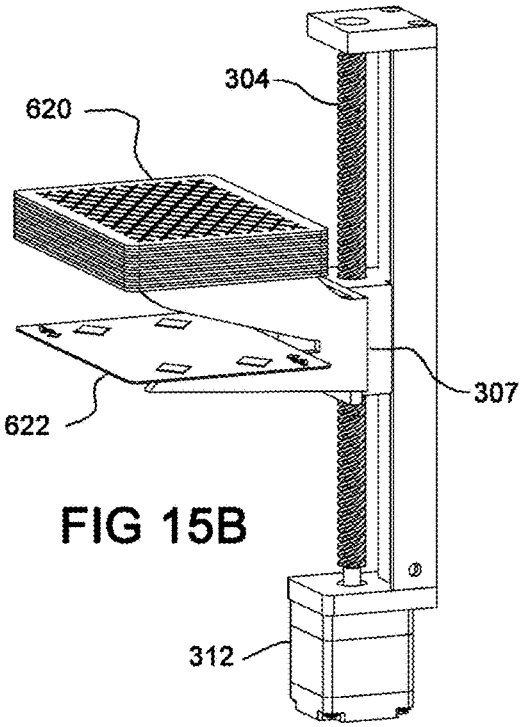
FIG. 15*b* is an isometric view of the elevator assembly of the first embodiment supporting a stack of cards upon a first support and supporting a single flipped card upon a second support.

The orientation of a card stack 620 is shown mounted upon the first support when in transit upon the elevator carriage 307 in FIG. 15A. During randomization, the carriage 307 oscillates vertically such that the card stack 620 can be split at various random locations in order to create an opening for inserting a new card into the stack (explained below). As shown in FIG. 15B, a faulty card (four of diamonds) is shown mounted upon the support arms 309A and 309B which are designed to support a single card. The faulty card is shown face-up such as to illustrate the exemplary case where a flipped card has been encountered. The cards residing on both elevator carriage supports are loosely constrained laterally on four sides by the chamber walls of chamber 186 such that they move freely with the elevator supports.

Figure 3:
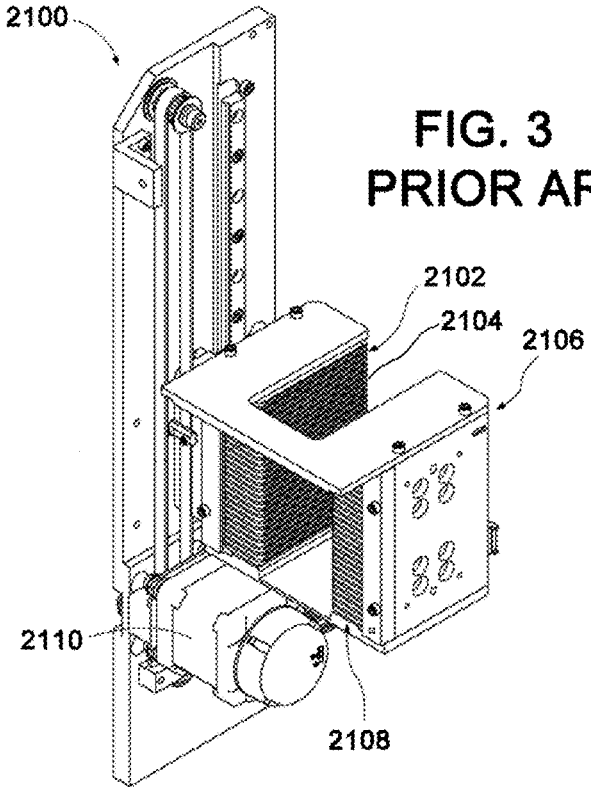
FIG. 3 PRIOR ART
FIG. 3 is an isometric view from a prior art shuffling device disclosure having an elevator with narrow slots.

Improved reliability is achieved of the card handling device being described herein by implementing a unique elevator mechanism which avoids the jamming problems associated with narrow slotted compartments that result from warped cards or bent cards. The problem of narrow slots is discussed within the disclosure of U.S. Pat. No. 11,338,194 (Helgesen '194) which can be understood by observing FIG. 3. Helgesen '194 explains:

> "For example, one card in a deck may be bent or warped—causing the card to regularly fail to insert into its assigned upper or lower position during each shuffle." (Helgesen '194 col. 28; lines 63-65)

A more reliable randomizing mechanism was taught by prior art U.S. Pat. No. 5,683,085 (Johnson '085), which discloses a randomizing apparatus that is devoid of narrow-slotted combs, racks and compartments. As shown herein as FIG. 6, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts sub-stack 2202 at random positions which enables the insertion of an individual card 2210 from a secondary deck (unshuffled deck) 2212. The separating mechanism creates an opening between two sub-stacks 2202 and 2204, which allows the insertion of card 2210 from the secondary stack 2212 into the receiving stack at the opening. Johnson '085 simulates the well-known action that a dealer utilizes to manually insert a "cut card" into a deck as illustrated herein as FIG. 7.

Figure 6:
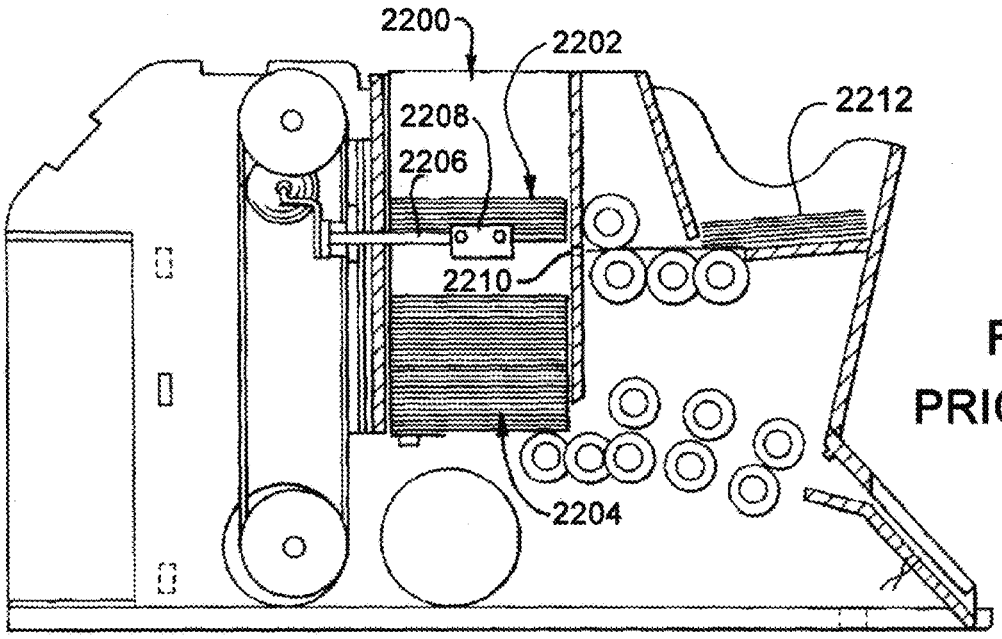
FIG. 6 PRIOR ART
FIG. 6 is a side elevation view from a prior art shuffling device disclosure which uses a pair of gripper arms to grasp stacks of cards.
Figure 8B:
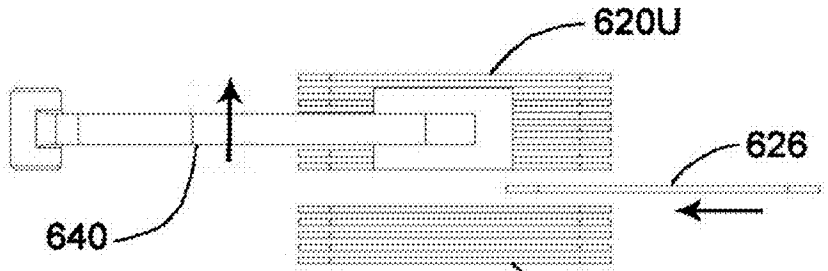
FIG. 8B PRIOR ART
FIG. 8A and FIG. 8B are diagrams which explain the sequence of movements utilized by the prior art gripper mechanism of FIG. 6.
Figure 8A:
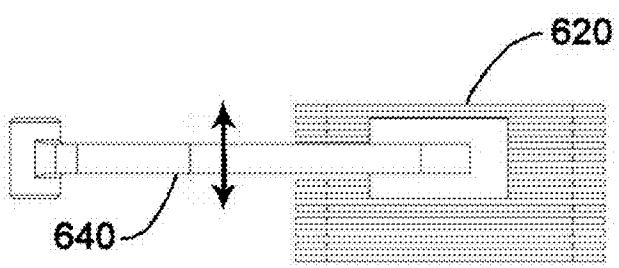
FIG. 8A PRIOR ART

The Johnson Method as shown in FIG. 6 illustrating Johnson '085 can be further understood from FIGS. 8A and 8B where a generic gripper arm is labeled 640. The gripper arm is mounted to an elevator which positions the arm at random vertical planes adjacent to the card stack 620 as shown in FIG. 8A. Referring to FIG. 8B, the gripper arm thereafter grasps a portion of the card stack 620U and lifts it upward, creating an opening to insert a playing card 626. The gripper arm thereafter lowers the upper stack onto the lower stack. The cycle is repeated until the desired number of cards are inserted randomly into the card stack 620.

Figure 9B:
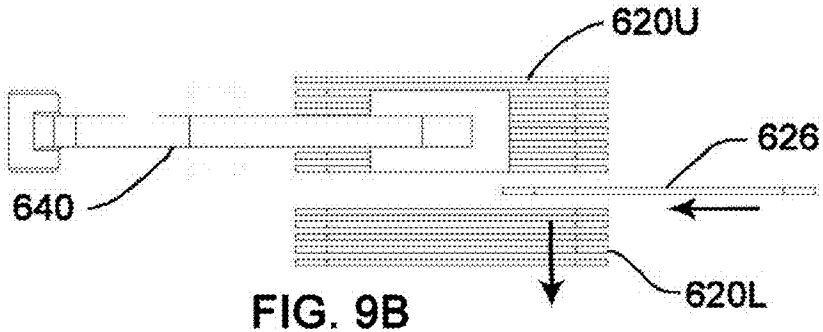
FIG. 9B PRIOR ART
FIG. 9A and FIG. 9B are diagrams which explain the sequence of movements utilized by another prior art gripper mechanism.
Figure 9A:
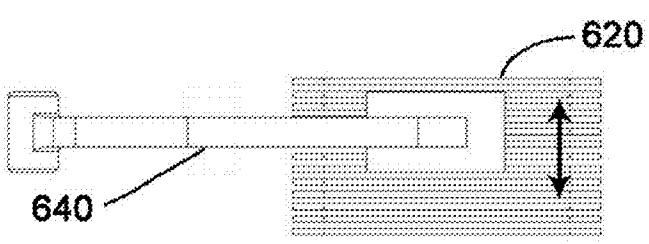
FIG. 9A PRIOR ART

Subsequent prior art U.S. Pat. No. 6,651,982 (Grauzer '982) also adopted a gripper mechanism. Whereas Johnson '085 has elevated the gripper to select a subset of cards, Grauzer '982 discloses that the gripper is held stationary, while the platform below is vertically lowered away from the gripper. Referring to FIGS. 9A and 9B, Grauzer '982 mounted the gripper arm 640 in a vertically stationary position and instead moved the card stack 620 with the elevator. After splitting the stack 620, the sub-stack 620L was lowered to create the opening for inserting card 626. After insertion, the lower substack 620L was thereafter raised to abut against the upper sub-stack 620U and the gripper was released. As compared to Johnson '085, Grauzer '982 lowered the lower sub-stack 620L rather than raising the upper sub-stack 620U as was taught by Johnson '085. Both prior art disclosures taught the advantages of avoiding narrow-slotted elevators or carousels.

Figure 16:
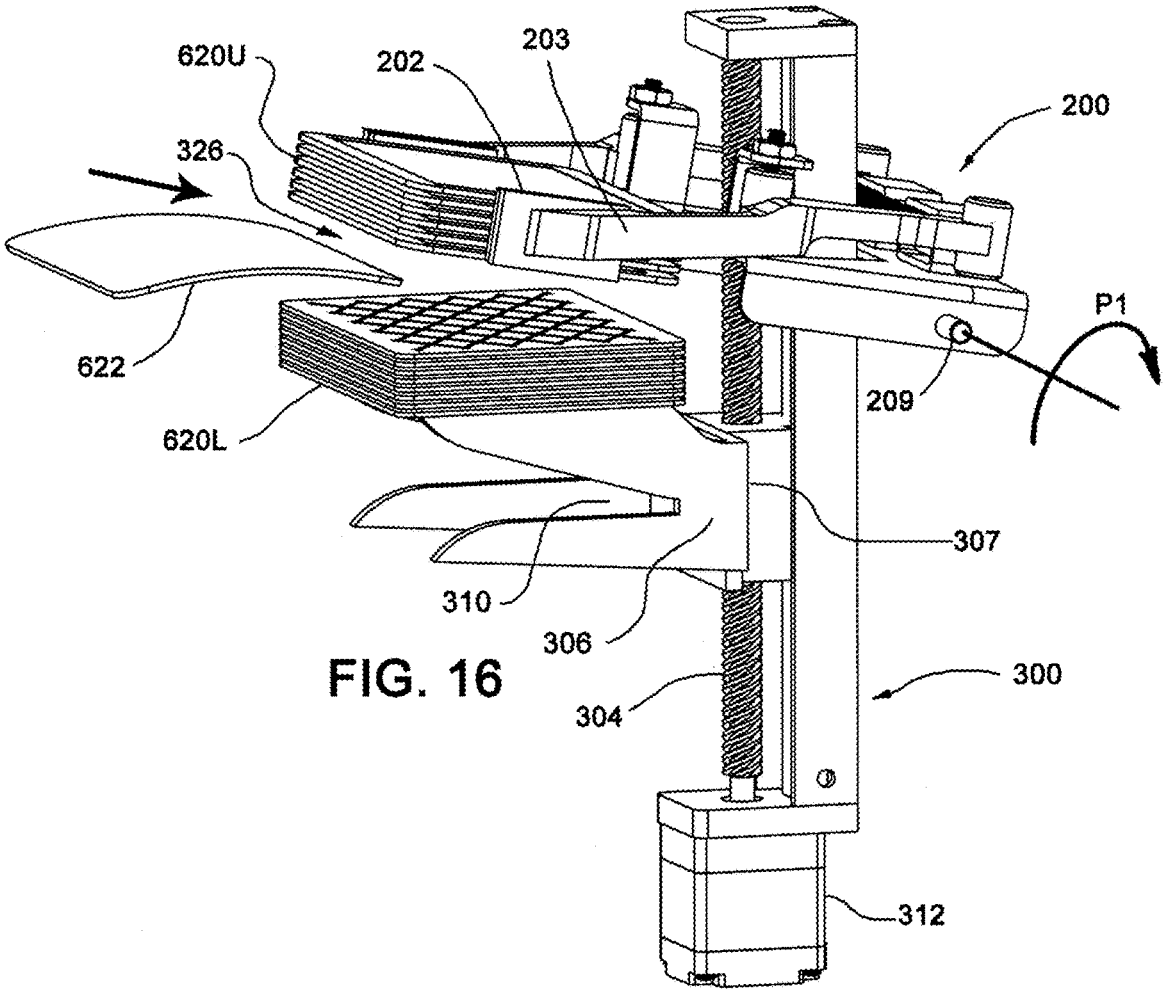
FIG. 16 is an isometric view of the gripper mechanism creating a random wedge-shaped opening between two sub-stacks of cards.

The randomizing mechanism of the present invention is devoid of narrow slots, carousels, combs, racks, or ejector blades that are previously known to be vulnerable to jamming in other prior art devices that use narrow slotted combs or carousels. Referring to FIG. 16, a section of the card stack being randomized is raised by a gripper mechanism 200 which creates a randomly chosen wedge-shaped opening 326 for oblique insertion of a card from the unshuffled stack, raises an upper sub-stack 620U, and thereafter lowers the upper sub-stack 620U onto the newly inserted card. The large wedge-shaped opening 326 is tolerant of the elevator position (also known as "position tolerant") during card insertion, thereby reducing the vulnerability to bent or warped cards as depicted by card 622 in FIG. 16.

Figure 7:
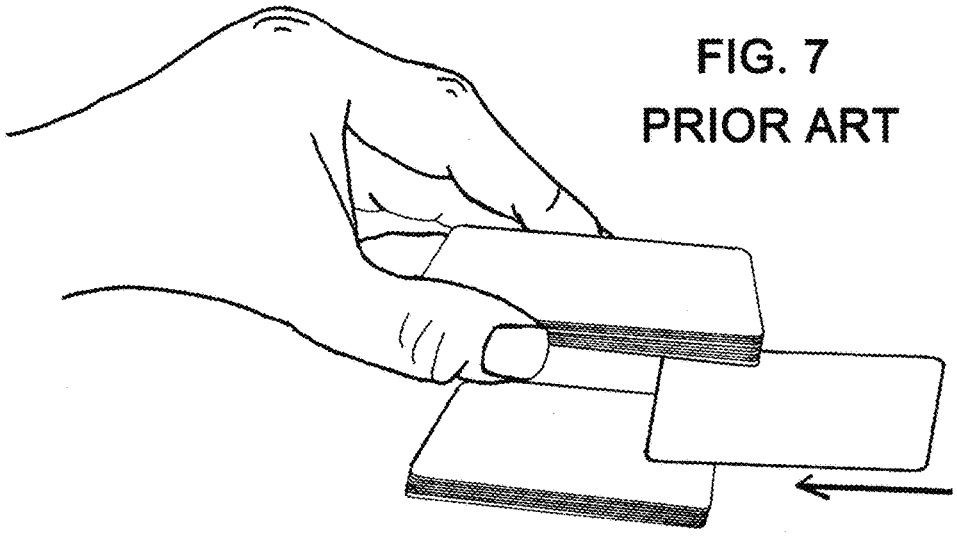
FIG. 7 PRIOR ART
FIG. 7 is a diagram which explains the human action that is emulated by the device in FIG. 6.
Figure 17:
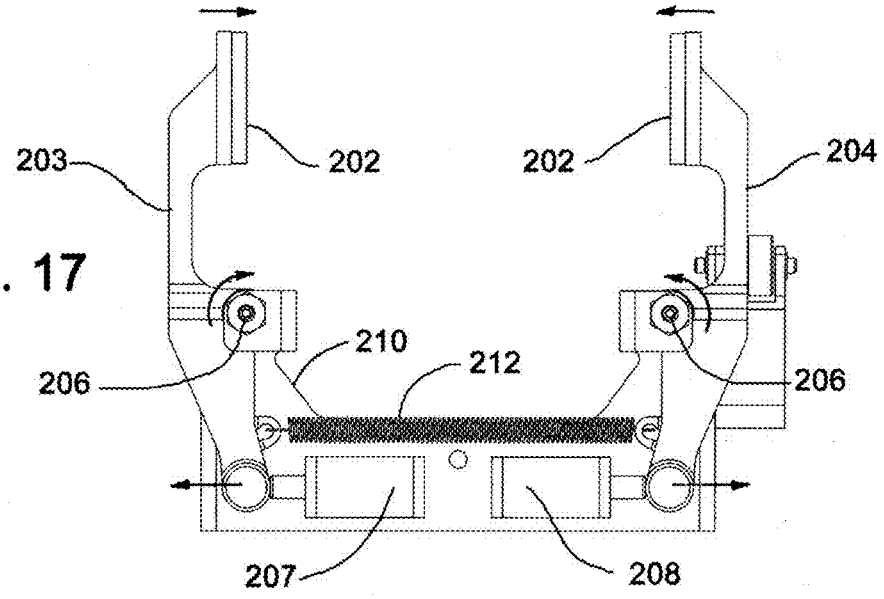
FIG. 17 is a planar view of the gripper mechanism used to randomize cards.

The randomizing method utilized herein also emulates the motion of a human dealer when cutting a card into a card deck as shown in prior art FIG. 7. Referring to FIG. 17, a gripper assembly 200 emulates the gripping motion of a dealer's fingers. Two gripper pads 202 are mounted on the terminal ends of a first gripper arm 203 and a second gripper arm 204, with each pivoting upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack as shown in FIG. 16. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of card stack 620.

Figure 18:
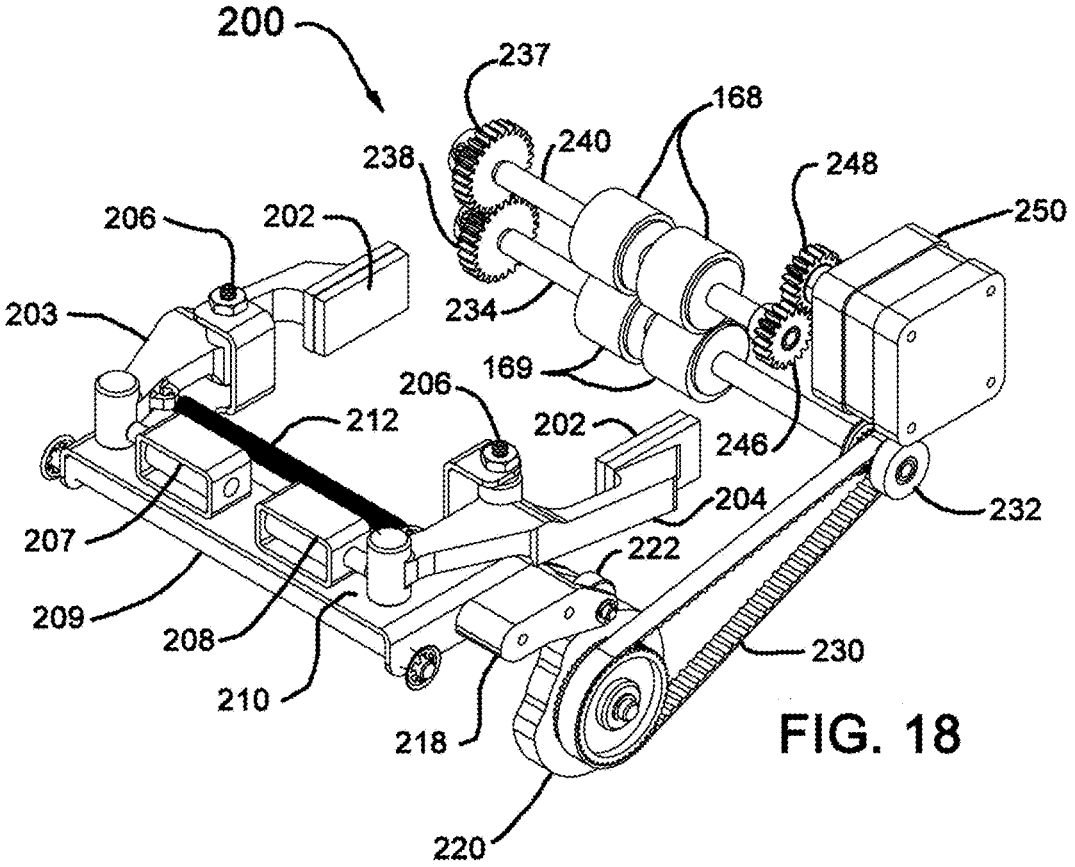
FIG. 18 is an isometric view of the gripper mechanism which is used to grasp and raise a substack of randomized cards.
Figure 19:
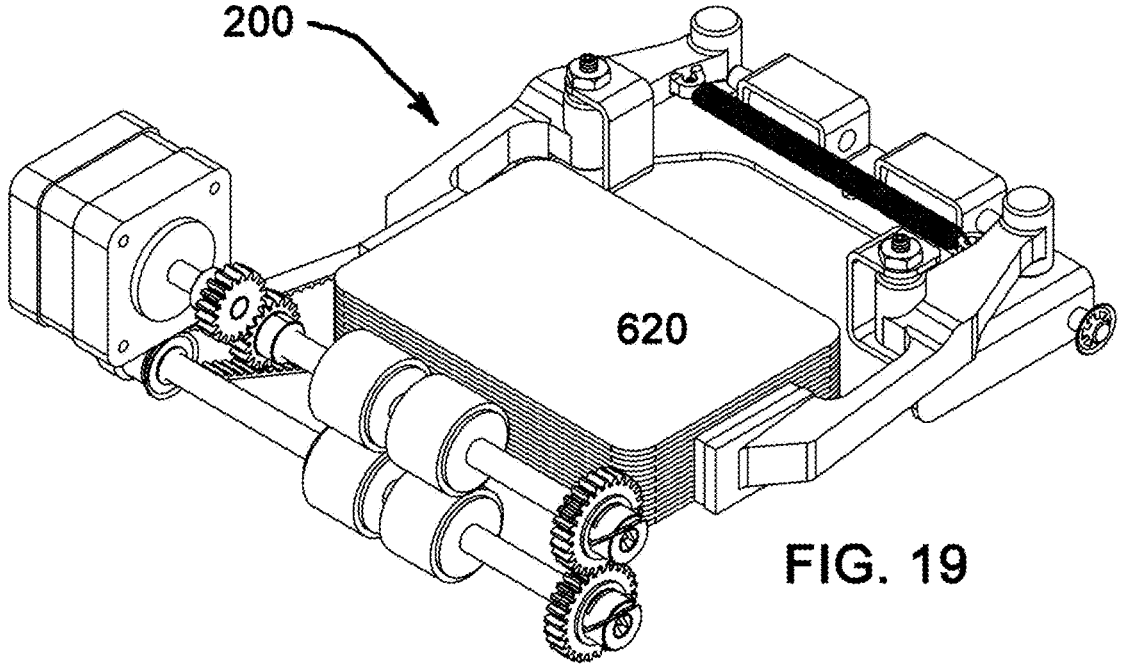
FIG. 19 is an isometric view of the gripper mechanism while grasping a stack of cards.
Figure 20:
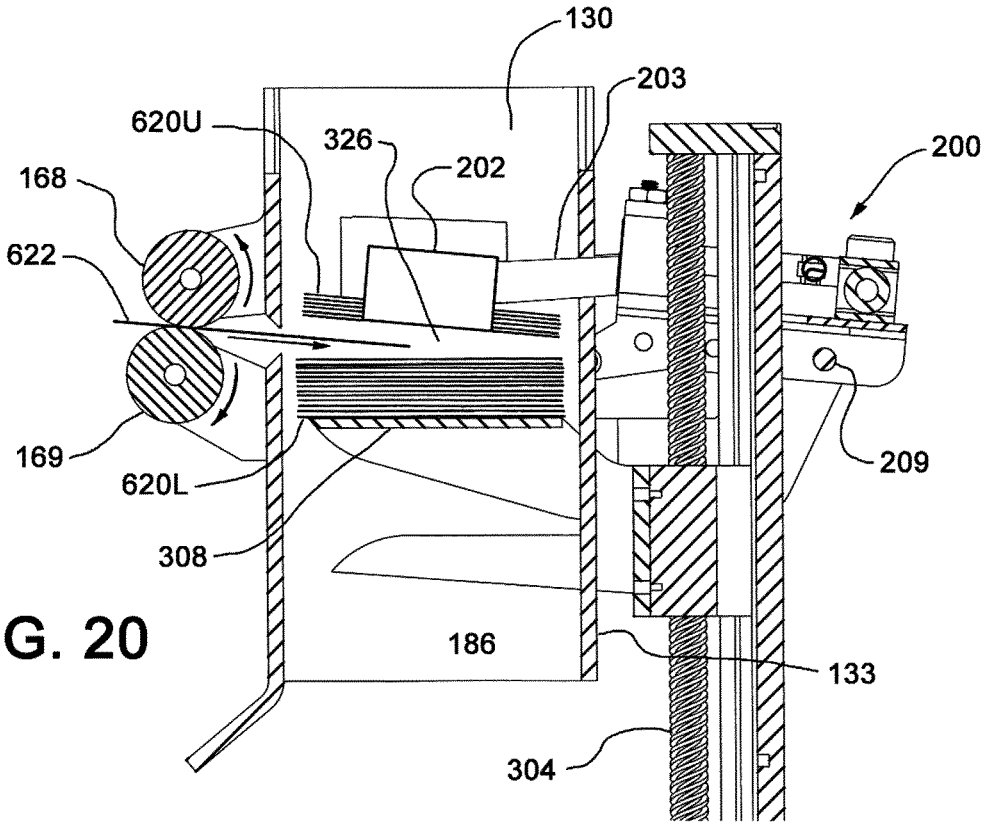
FIG. 20 is a cutaway side view of the randomizing mechanism showing a card being inserted into a randomly created wedge-shaped opening in the receiving card stack.
Figure 21:
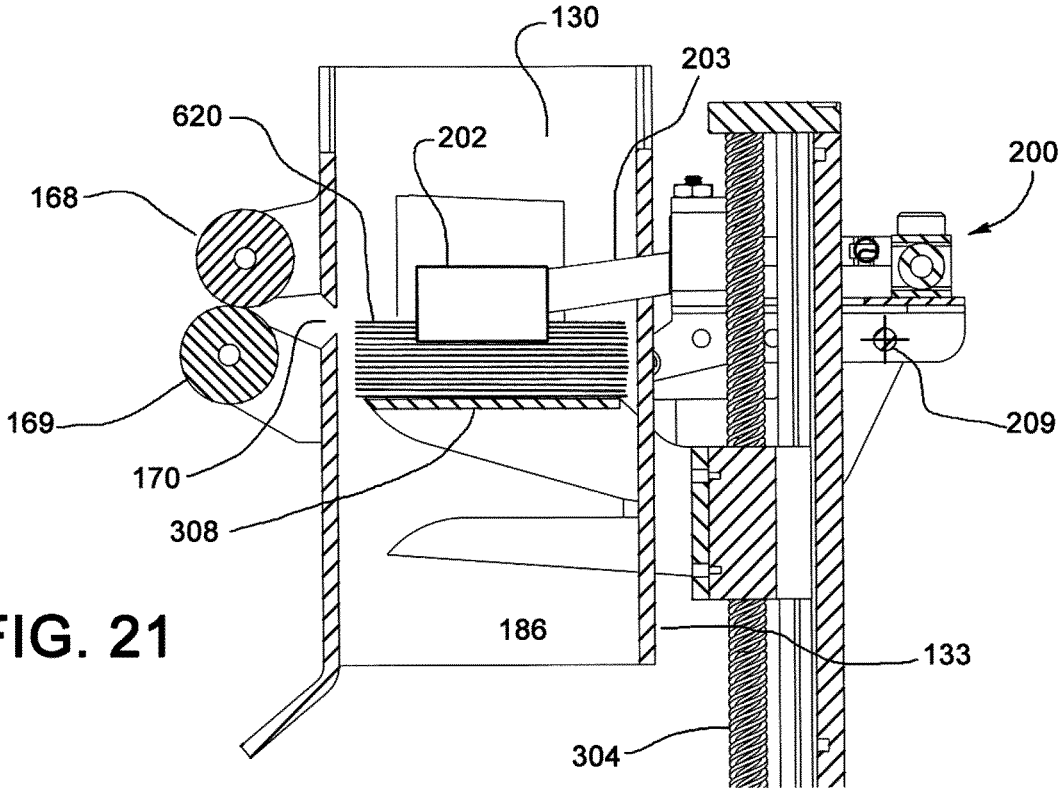
FIG. 21 is a cutaway side view of the randomizing mechanism showing the receiving card stack after the upper sub-stack has been lowered onto the newly inserted card by the gripper mechanism.

The complete gripper assembly 200 is shown in FIG. 18 where the gripper frame 210 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle the card stack 620 is grasped by the gripper arms 203 and 204, and thereafter lifted by the cam 220 to move an upper sub-stack of cards 620U upward through an arc. The motion is illustrated in FIG. 16, FIG. 20 and FIG. 21 where the upper sub-stack is shown as 620U.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 16. A lower card sub-stack 620L is shown supported by the elevator platform 308, while an upper card sub-stack 620U is shown lifted in an arc about pivot P1 which is locationally fixed to the frame of card handling device 100. The vertical position of the split between the upper sub-stack 620U and the lower sub-stack 620L is determined by the microcontroller which relocates the elevator carriage 307 just prior to the gripping cycle. As shown in the side elevation section views of FIG. 20 and FIG. 21, the elevator platform 308 positions a card stack 620 in a randomly selected elevation and the gripper assembly 200 thereafter splits the card stack through an arc at the random location. The lower sub-stack 620L is held stationary by the elevator platform 307 while the gripper arms 203, 204 raise the upper sub-stack 620U, and while a new card 622 is inserted into the wedge-shaped opening 326 (FIG. 16). As illustrated in FIG. 16, the axis of the elevator may form an angle with the surface of the casino table that is other than perpendicular.

Figure 4:
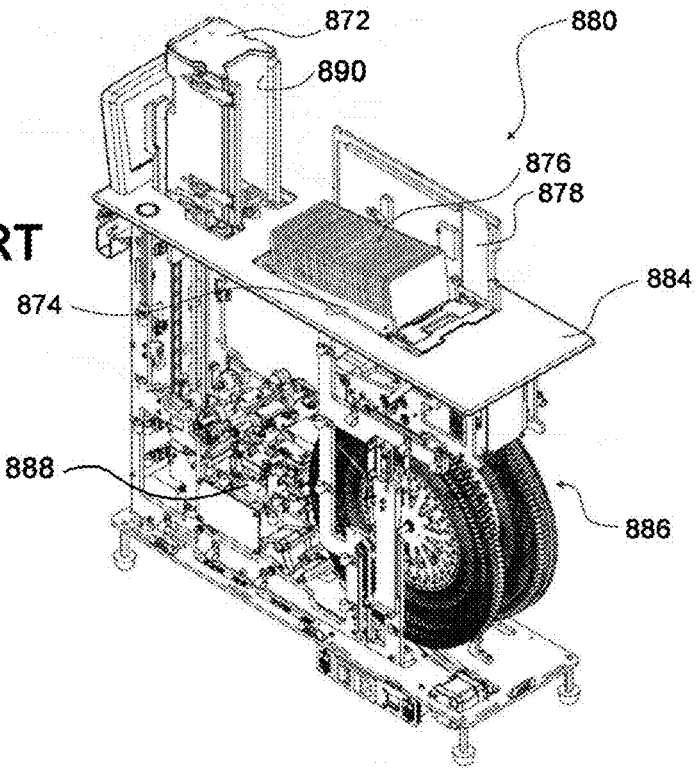
FIG 4. PRIOR ART
FIG. 4 is an isometric view from a prior art shuffling device disclosure which stores flipped cards in one particular compartment of a carousel.
Figure 5:
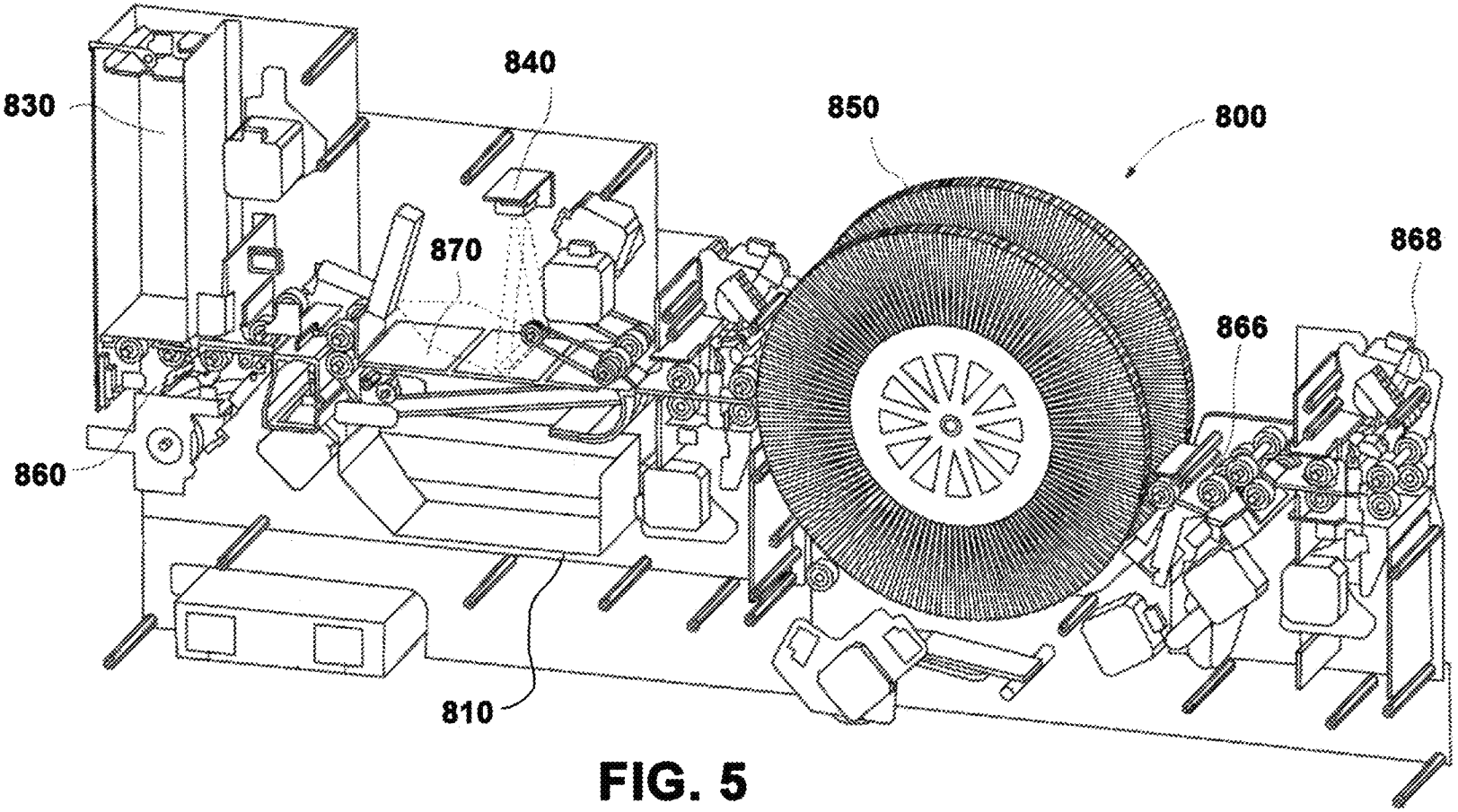
FIG. 5 is a perspective view from a prior art shuffling device disclosure which diverts unreadable cards to a vault.

The purpose of the cam 220 shown in FIG. 18 is two-fold. First, the gripper assembly 200 creates a large wedge-shaped opening 326 which is tolerant to curved or bent cards as illustrated by warped card 622 in FIG. 16. The large wedge-shaped opening 326 overcomes the jamming problem exhibited by prior art narrow slot carousel and moving comb shuffling devices shown in FIG. 3, FIG. 4 and FIG. 5. Secondly, the cam 220 is designed to alleviate the cyclic life burden on the components of the elevator assembly 300. The prior art devices that utilized gripper mechanisms (see prior art FIG. 8A through FIG. 9B) required three elevator motions for each card insertion; a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of the embodiments herein relocates just once during each card insertion cycle, thereby extending the service life of the elevator assembly 300 as compared to the prior art.

Figure 25A:
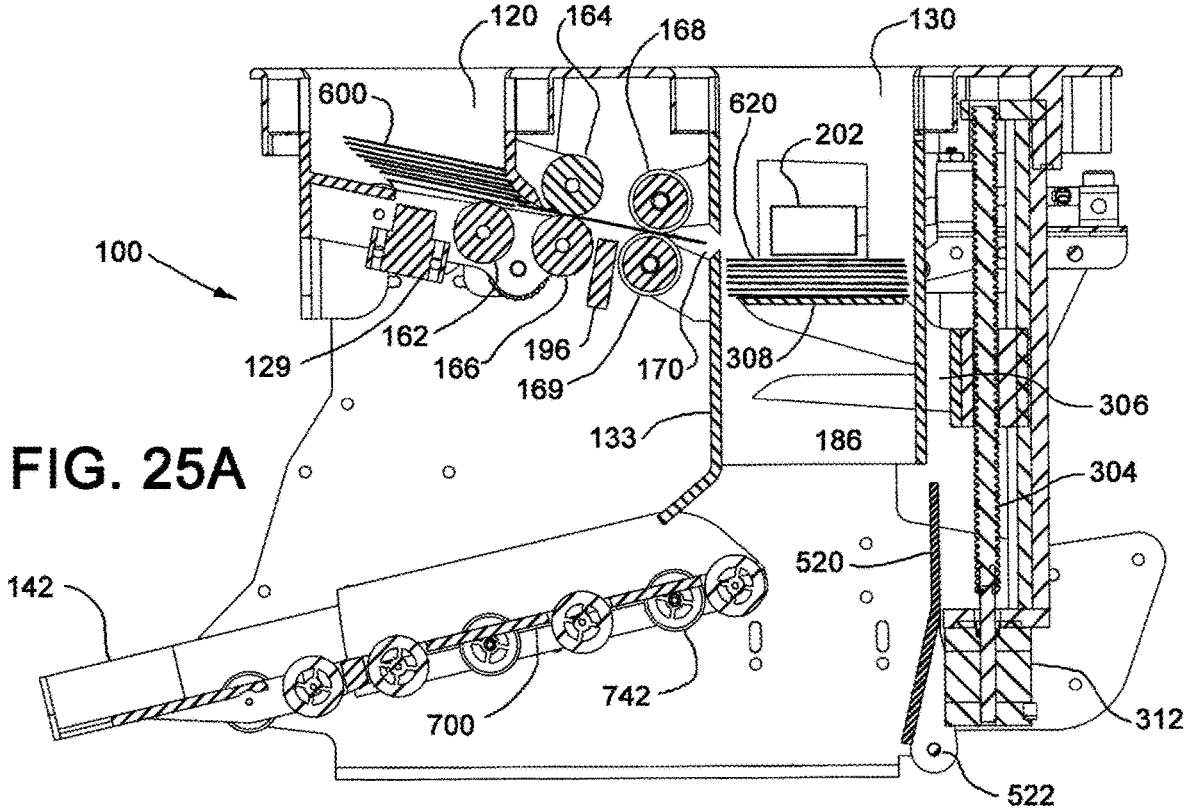
FIGS. 25A, 25B, 25C, and 25D are side elevational section views of the first embodiment herein which stepwise illustrate the migration of playing cards as they move through the card handling device to the output portals.

The previously described grasp-elevate-insert-release cycle is repeated for each of the cards in an unshuffled deck until all cards have been transferred to the card stack 620 in the randomizing chamber 186. The card stack 620 thus begins with one card and builds to a full deck of 52 cards in the case that 52 cards is the desired deck size. The randomizing cycle will automatically start when the dealer activates a "Shuffle" command on the touch screen as long as sensor 129 detects the presence of a card in the input portal 120. Referring to FIG. 25A, a series of feed rolls 162, 166, and 164 strip the bottom card from the stack of cards 600 and move that card past the interrogation sensor 196. Feed rolls 168 and 169 then inject each non-faulty card into the randomizer chamber 186, whereupon each card is inserted into a growing card stack 620. Each new card is inserted into the card stack 620 at randomly chosen elevated positions by the microcontroller, which utilizes a random number generating algorithm to determine the height of each plane between two adjacent cards within the receiving card stack 620. Random number generating algorithms are known in the art as RNG's. The RNG of card device 100 insures that each card is inserted into the stack 620 at a random position.

Termination of the randomizing cycle is detected by the microcontroller via sensor 129 (see FIG. 13) which indicates when the supply of unshuffled cards has been exhausted. Upon termination of the randomizing cycle, the microcontroller directs that the elevator raise the play-ready card stack 620 to the first discharge portal 130.

Figure 22:
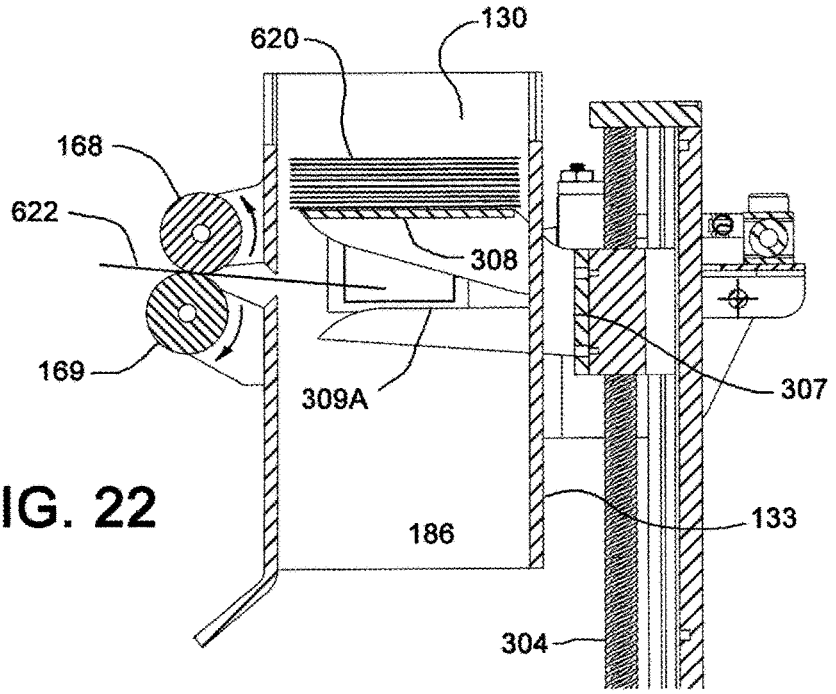
FIG. 22 is a section view of the randomizing chamber receiving a faulty card upon the second card support.

During the randomizing cycle the microcontroller may identify a card that satisfies a fault criteria, including unreadable cards and flipped cards. The microcontroller immediately directs the elevator to align with card path such that the faulty card is inserted onto the forked supports 309A and 309B (FIG. 14) of elevator 307 as shown in the section view of FIG. 22. Referring to FIG. 22, the elevator 307 has been raised to allow faulty card 622 to be inserted into the slot above surface 309A of the fork-shaped elevator 307. This results in the elevator supporting both the faulty card 622 and the stack of non-faulty cards 620 as shown in FIG. 15B.

Figure 23:
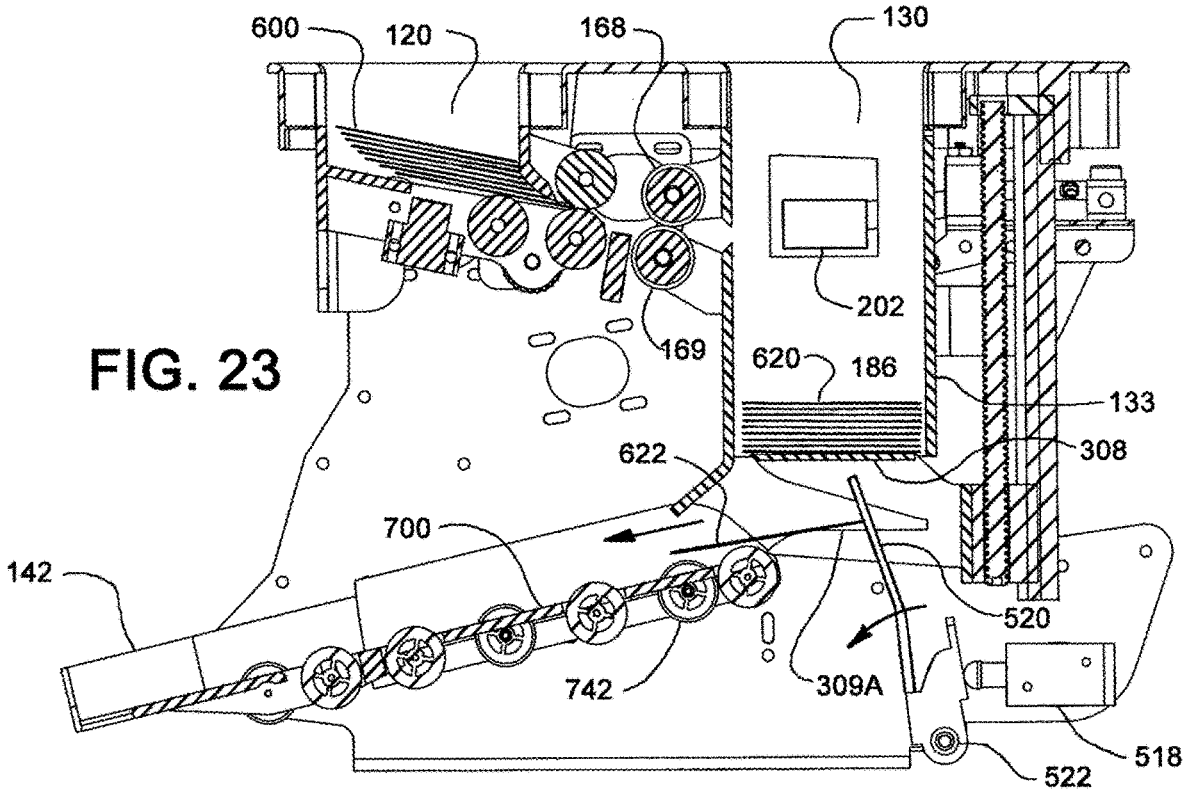
FIG. 23 is a section view of the device of the first embodiment showing a faulty card being moved to the second discharge port.

Thereafter, the microcontroller lowers the elevator to an ejection station whereupon an ejection mechanism 500 moves the faulty card onto the discharge track 700. Referring to FIG. 23, a solenoid-activated arm 520 is rotated about pivot 522 by activated solenoid 518 to eject the faulty card 622 onto the track 700, whereupon inertia carries the card to the output tray 142 in the second discharge portal 140. Following the ejection of the faulty card, the elevator is raised to receive the next non-faulty card into the stack 620 which is being randomized during the ongoing randomization operation.

Figure 24:
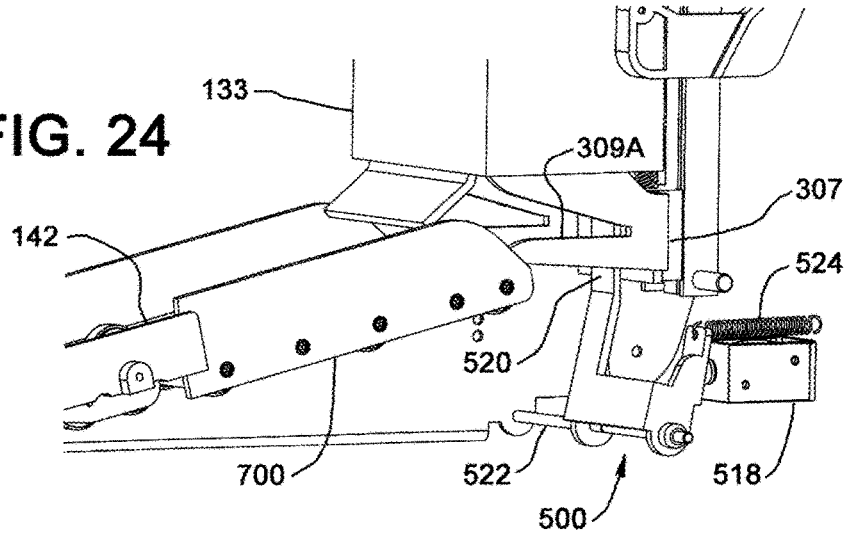
FIG. 24 is an isometric view of the faulty card ejection mechanism of the first embodiment.

FIG. 24 illustrates the ejection mechanism 500 when it resides in the deactivated state. Arm 520 rotates about a pivot shaft 532 which is journaled in the two sideframes and held in the deactivated position by restore spring 524. Activation of solenoid 518 causes the upper portion of arm 520 to move within the space between arms 309A and 309B to propel a single card toward discharge portal 140 when a card resides upon the arms.

A more detailed explanation of the card movements can be observed from FIGS. 25A, 25B, 25C, and 25D, which explain the movement of cards within and through the card handling device 100. FIG. 25A shows a new or spent deck 600 (unshuffled) located in the input portal 120 as the deck is being randomized (shuffled). When the dealer activates a shuffle command on touch screen 114, the microcontroller interrogates sensor 129 to determine if any card is present in the portal 120. If a card is detected by the sensor 129, the microcontroller will activate motors (not shown) that rotate feed rolls 162, 166 and 164 until the leading edge of a card is detected by verification sensor 196.

Figure 25B:
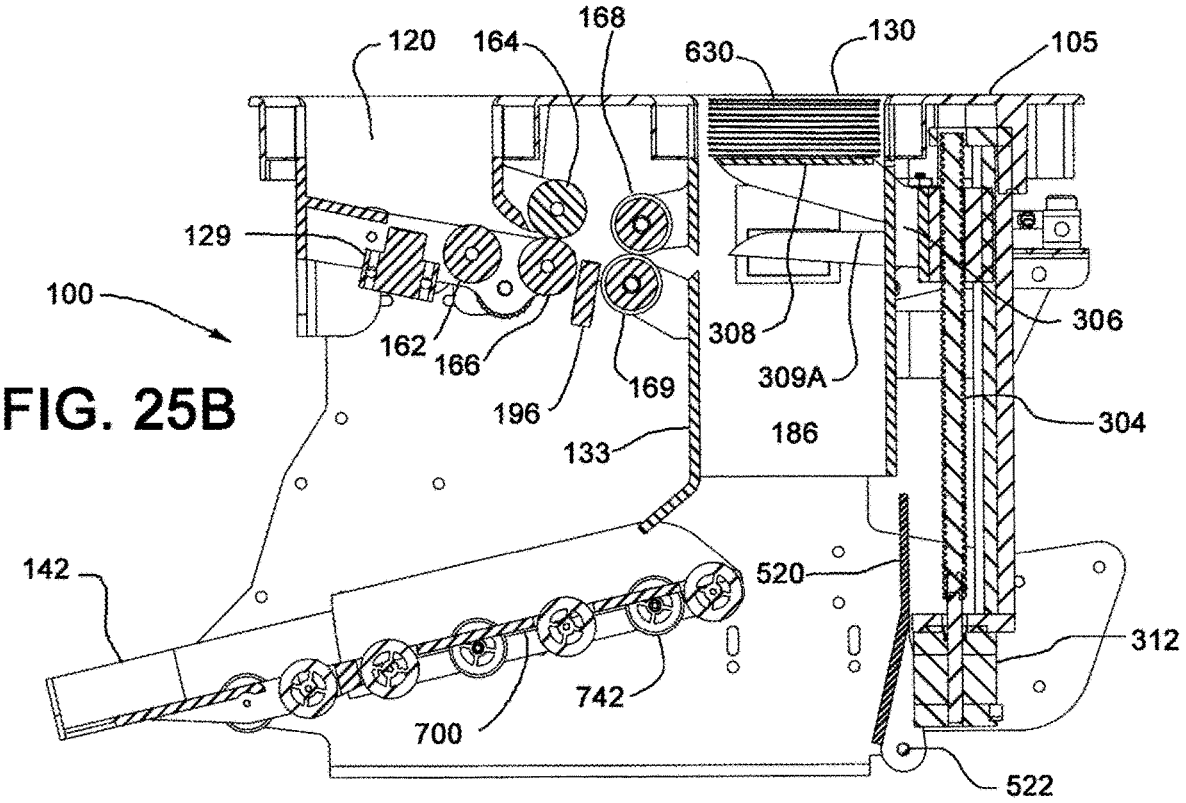

In FIG. 25A, an unshuffled card of a card deck 600 is moved face-down past the verification sensor 196 and is about to enter the randomizing chamber 186, where the card stack 620 is supported by platform 308 of the elevator carriage 307. The microcontroller activates a motor (not shown) to rotate feed rolls 168 and 169 which feed the cards of the card stack 600 into the randomizing chamber 186 through a slot 170 in the housing 133. The verification sensor 196 is utilized to read identification marks or indicia that indicate the identity of each card. The sensor 196 may be any optical recognition sensor as taught in the prior art, including a reflective opto-sensor, an infrared mark detector, a digital camera, a CMOS camera, a color pixel sensor, a contact image sensor (CIS) or a CCD image sensor. In the preferred embodiment, the sensor 196 is a contact image sensor and is used to read the rank and suit in the upper right corner of each card. This optical recognition process will continue until sensor 129 signals that no more cards are available in the card input portal 120. As each card passes the interrogation sensor 196, the microcontroller will determine if any fault condition exists, including unexpected or unreadable cards. Non-faulty cards will thereafter be moved to a random elevation within the stack 620 which is supported by elevator platform 308. When sensor 129 indicates that no cards remain in portal 120, the microcontroller raises the play-ready card stack 630 to the first discharge portal 130 as shown in FIG. 25B.

Figure 25C:
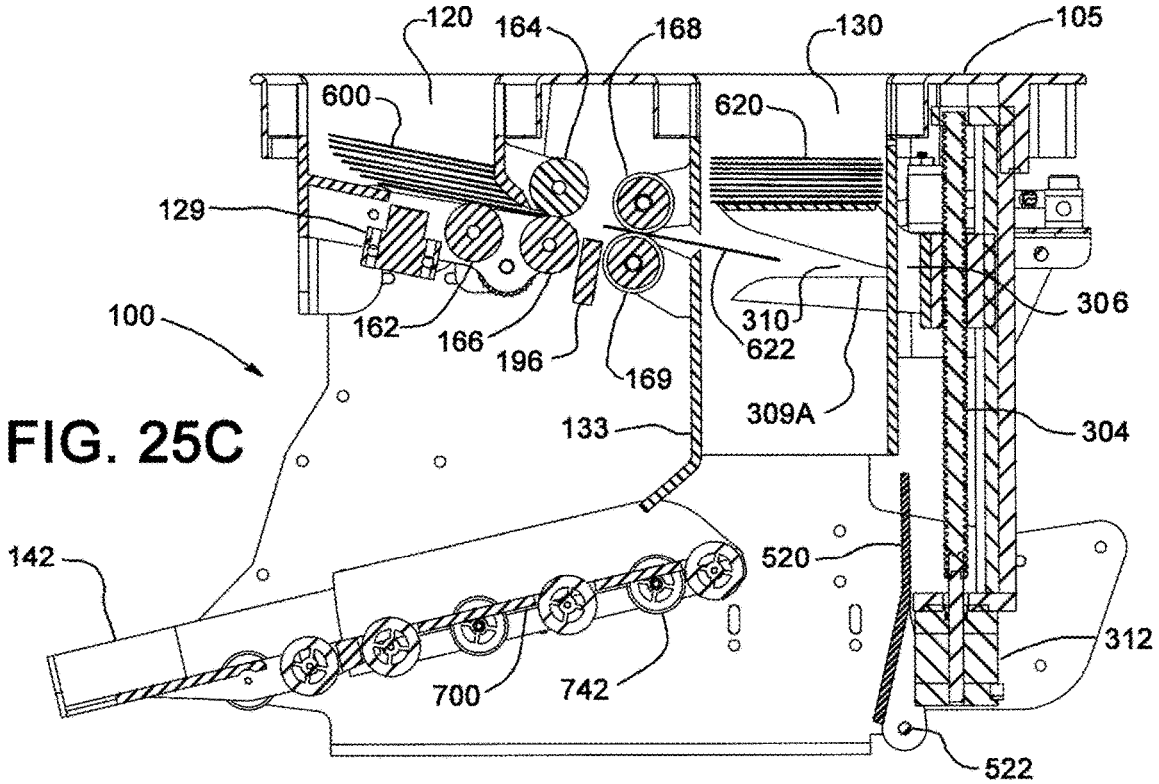
Figure 25D:
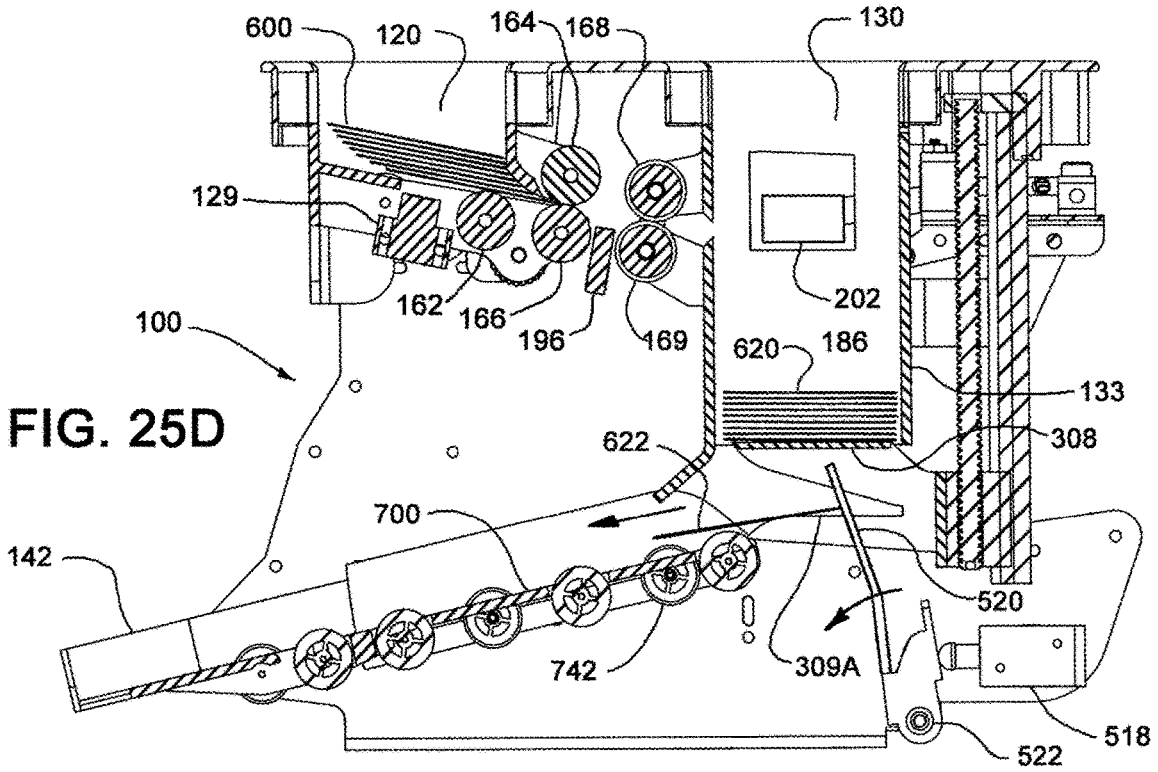

FIG. 25C illustrates the case in which the microcontroller has determined that a card is faulty and raised the elevator carriage 307 to a position which aligns the slot 310 in the forked-shaped carriage 307 with the card transport path. The faulty card 622 will thereafter be transported into the slot 310 and reside upon support surfaces provided by arms 309A and 309B. The elevator will be immediately lowered to a discharge station as shown in FIG. 25D. An ejection arm 520 is thereafter activated to eject the faulty card 622 onto the rolls 742 of discharge track 700 whereupon inertia moves the faulty card to output tray 142 within the second discharge portal 140. The elevator is thereafter raised to continue the ongoing randomization. If the faulty card is a flipped card, the orientation error will be immediately recognizable to the device operator as illustrated in FIG. 11.

As a faulty card discharge is completed, the microcontroller signals the fault condition on the touch screen 114. The automatic rejection of a faulty card relieves the operator of any distraction or interruption in table play that would otherwise later require a dealer to tediously unload a shuffling apparatus as in the case of conventional compartment type shufflers. Moreover, the card handling device denies the operator/and or dealer the discretion to continue play with a corrupt card as in the case of cheating or player-dealer collusion.

Figure 26A:
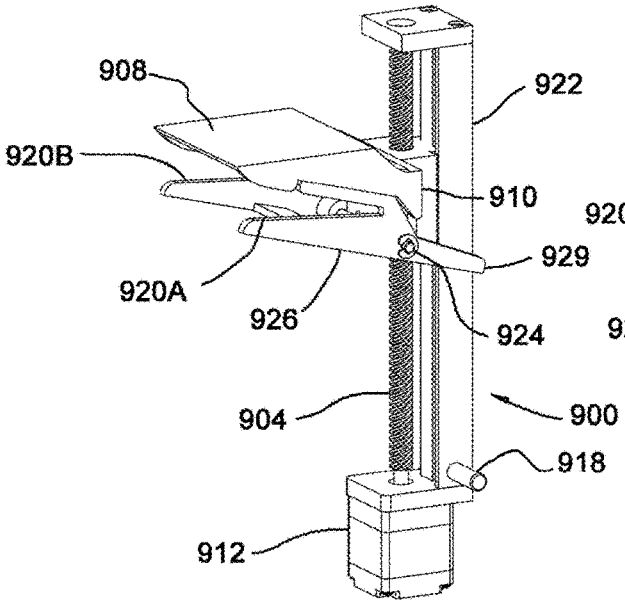
FIG. 26A and FIG. 26B illustrate the rotating fork of the second embodiment.
Figure 26B:
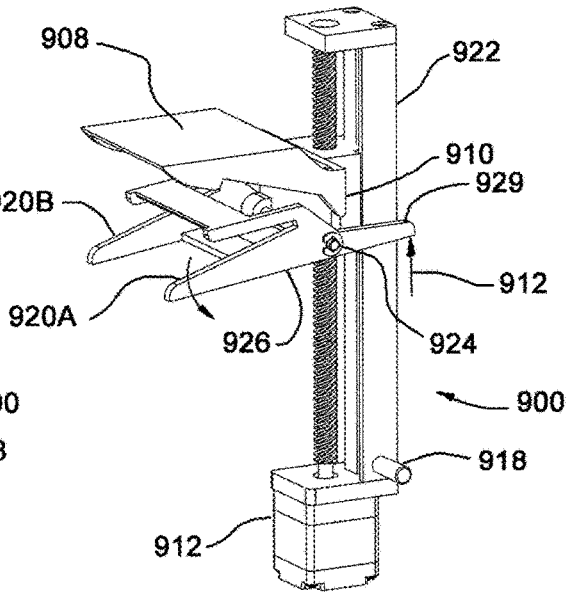

A second embodiment of the card handling device differs only in the configuration of the forked-shaped elevator. The second embodiment eliminates the solenoid-activated ejector mechanism 500, and instead utilizes a self-actuated rotating fork. FIG. 26A and FIG. 26B illustrate the configuration of the rotating fork.

As shown in FIG. 26A, the elevator assembly 900 possess a frame 922, a lead screw 904, a carriage 910, and a step motor 912 which rotates the lead screw. The carriage 910 comprises a platform 908 and a rotating fork 926 which rotates upon pivot shaft 924. A torsion spring (not shown) retains the rotating fork 926 against a mating surface of the carriage 910 in the position shown in FIG. 26A. The platform 908 forms a first card support which is designed to carry a stack of cards. The rotating fork 926 forms a second card support which possesses two arms 920A and 920B which are designed to support a single card.

Figure 27:
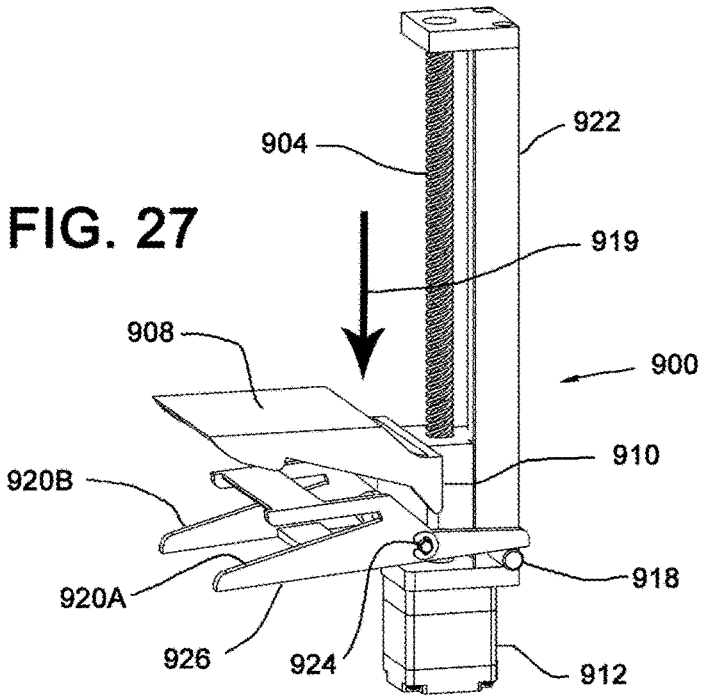
FIG. 27 illustrates the actuation of the rotating fork of FIG. 26A.
Figure 28:
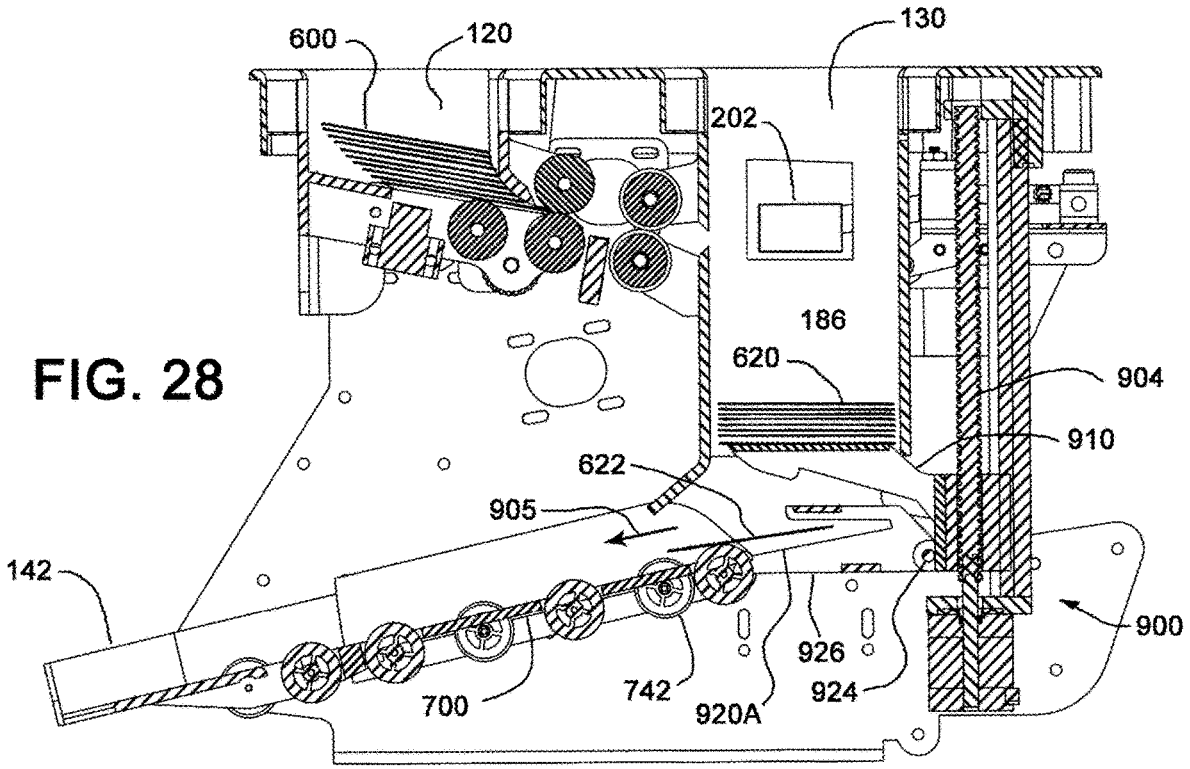
FIG. 28 is a side elevation section a view illustrating the faulty card discharge of the second embodiment.

FIG. 26B illustrates the rotatable fork 926 in its rotated state when a force acts upon its projection 929 in the direction of arrow 912. This rotation is designed to induce centrifugal force upon a card while ejecting the card which is carried upon arms 920A and 920B. Referring to FIG. 27, a stud 918 is attached to leadscrew frame 922. FIG. 27 illustrates that the rotation of fork 926 is induced by contact with stud 918 as the carriage 910 is lowered by lead screw 904 in the direction of arrow 919. FIG. 28 illustrates a section view of the second embodiment when the rotating fork 926 is activated by contact with the stud 918 as the elevator carriage is lowered. The sudden rotation causes the card 622 to be ejected onto the rolls 742 of the discharge track 700, whereupon inertia carries card 622 in the direction of arrow 905 to the discharge tray 142.

Figure 29:
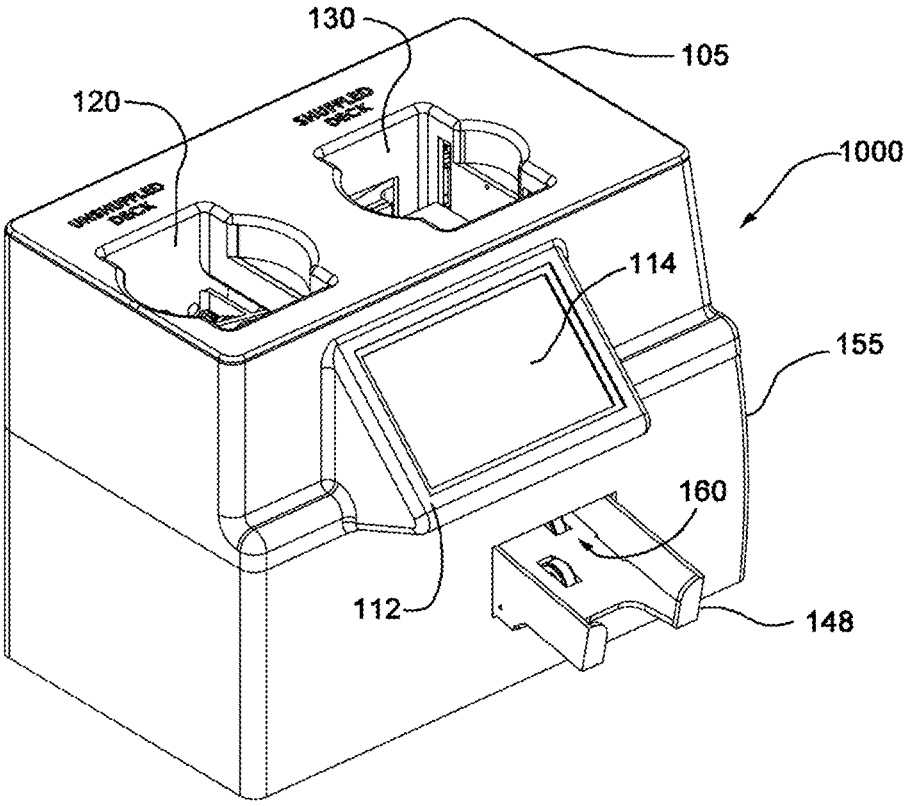
FIG. 29 is an isometric view of the device of the third embodiment.

A third embodiment of the card handling device is illustrated in FIG. 29 as device 1000. Device 1000 retains most of the components of device 100 including the card intake portal 120, the first card discharge portal 130 and the touch screen 114. The second card discharge portal is labeled 160 and has the function of containing an individually discharged faulty card that is discharged during an ongoing randomization process to the discharge tray 148.

Figure 30:
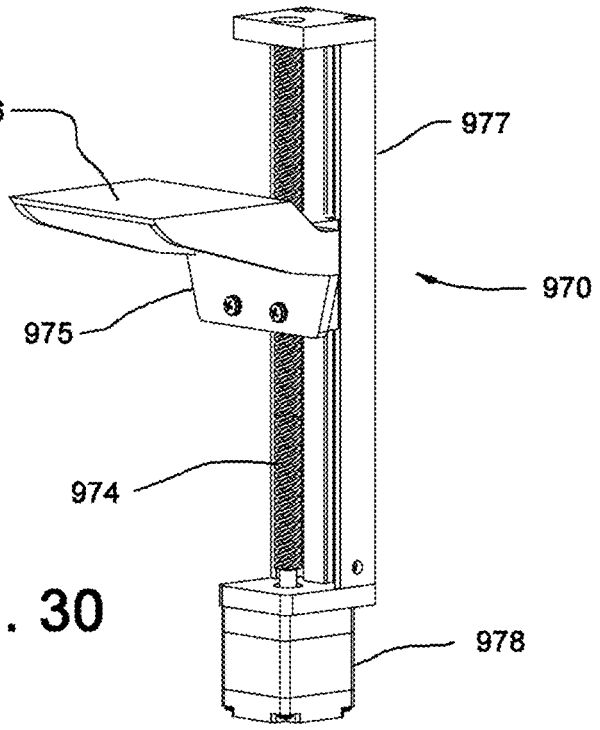
FIG. 30 is an isometric view of the elevator assembly of the third embodiment.

Device 1000 utilizes a single elevator which is actuated by a step-motor driven lead screw as shown if FIG. 30. Referring to FIG. 30, the elevator carriage 975 possesses a single platform 976 for supporting a stack of cards in the third embodiment.

Figure 31:
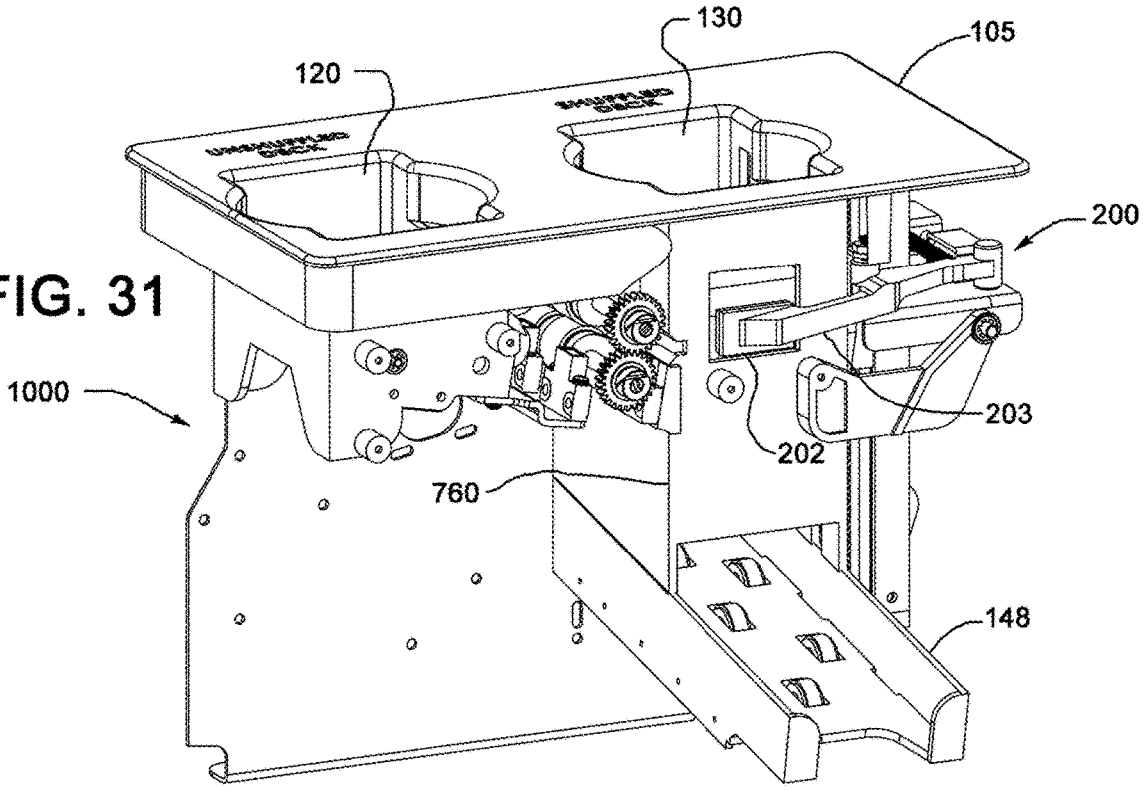
FIG. 31 is an isometric view of the discharge tray of the third embodiment.

The randomization chamber housing 760 of the third embodiment is shown in FIG. 31. In comparison to the other embodiments, the randomization chamber of the third embodiment is extended downward and configured to mate angularly with discharge tray 148 which resides within the second discharge portal 160. The card transport and the gripper mechanism 200 are the same as described in the other embodiments.

Figure 32:
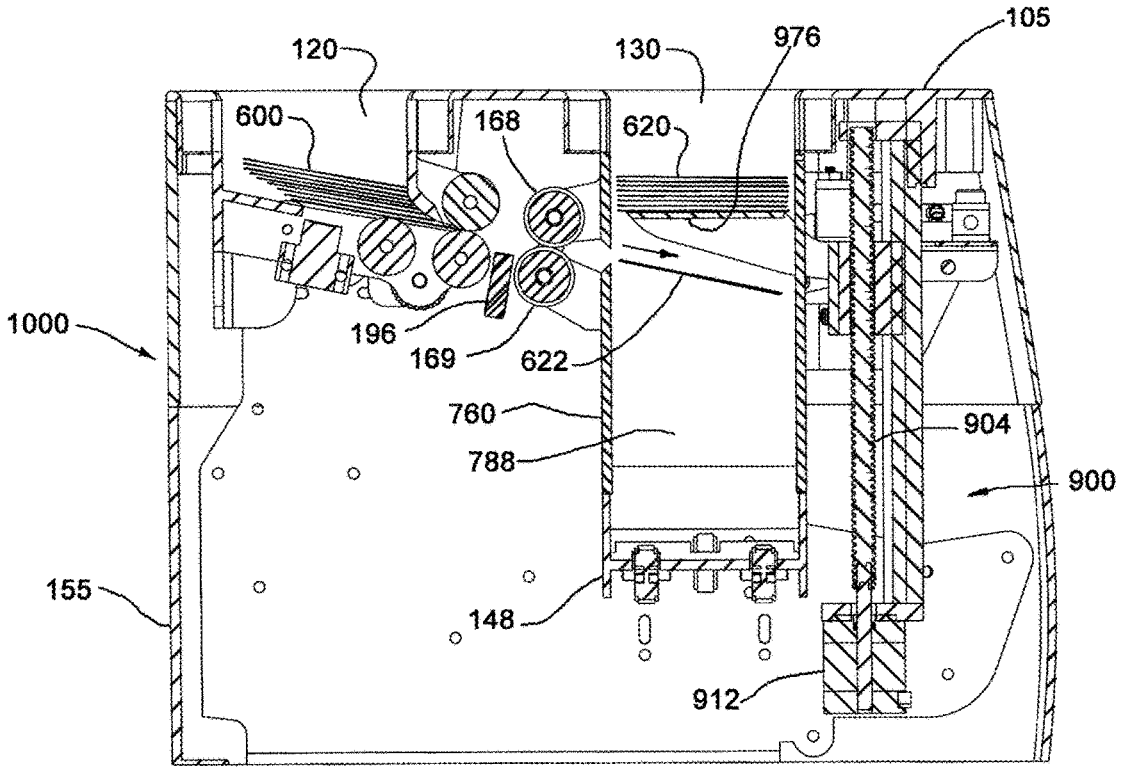
FIG. 32 is a side elevation section view of the third embodiment illustrating a faulty card being discharged by gravity.

FIG. 32 is a sectional view of device 1000 which illustrates that a faulty card, once identified, is immediately moved directly into the randomization chamber and allowed to free fall by gravity to the discharge tray 148. Referring to FIG. 32, card stack 600 is undergoing randomization and non-faulty cards 620 are being arranged upon platform 976 of the elevator. The microcontroller in cooperation with the interrogation sensor 196 has determined that card 622 is faulty. Thereafter, the microcontroller has directed the elevator to raise the stack 620, providing space for disgorging card 622 into the randomization chamber 788. The card 622 falls by gravity to output tray 148 as the elevator returns to the shuttling mode and continues the randomization operation.

In summary, three embodiments have been illustrated having the capability for immediately discharging individual faulty cards, including flipped cards, during an ongoing randomization operation. Each of these embodiments possesses a single elevator having a different carriage configuration from the others. The first embodiment utilizes an elevator carriage 307 having a forked shape as shown in FIG. 14A. Faulty cards are delivered individually to the second discharge portal 140 by inertia in this first embodiment as illustrated in FIG. 23.

The second embodiment utilizes an elevator carriage 910 having a rotating fork 926 as shown in FIGS. 26A and 26B. Faulty cards are delivered individually to the second discharge portal 140 by inertia in this second embodiment as illustrated in FIG. 28.

The third embodiment utilizes an elevator carriage 975 having a single platform 976 as shown in FIG. 30. Faulty cards are not transported by the elevator in this embodiment, but are rather moved individually to the second discharge portal 160 by gravity as illustrated in FIG. 32.

As is routinely noted in the prior art (see Roblejo '122 above), shuffling machines having interrogation capability may also be utilized merely for verification. The device herein may also be utilized for verification of card decks by selecting a menu option from touchscreen 114.

One of ordinary skill, having designer's choice, may choose to utilize different forms of actuators, sensors and transport components than those described herein. Other forms of transport components, including cables, gears, chains and other types of belts may be substituted for those described herein. Other types of motors and solenoids are also logical substitutions. Other sensors are also possible substitutes. A myriad of interrogation sensors have been taught tin the prior art that can perform the functionality explained herein Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handling device for randomizing and/or verifying integrity of a group of cards, the card handling device comprising:

a housing;

a card intake portal accessible by a device operator for receiving unshuffled cards to be randomized;

a first discharge portal accessible by a device operator for receiving randomized and properly verified card stacks from within the card handling device;

a second discharge portal visibly and physically accessible by a device operator for receiving flipped cards or other faulty cards one at a time from within the card handling device;

a control panel for indicating a status of a stack of cards;

a randomizing chamber for randomizing the order of a group of cards;

an elevator for moving cards within the randomizing chamber;

an optical recognition sensor configured to interrogate an identity of each card from within the unshuffled cards of the card intake portal;

at least one microcontroller configured to separate the faulty cards;

the at least one microcontroller directing movement of the elevator after deciding upon a destination for each interrogated card, and for providing status to a device operator;

the elevator having a first card support configured for accumulating and transporting the randomized and properly verified cards;

the elevator having a second card support configured for transporting one faulty card;

whereupon the at least one microcontroller is configured to direct each interrogated card to either the first card support or the second card support;

the elevator moving both upward and downward for receiving properly verified cards upon the first card support;

the elevator moving upward for receiving one faulty card upon the second card support;

wherein one faulty card residing on the second card support is discharged to the second discharge portal immediately after receipt upon the second card support; and, wherein the at least one microcontroller is configured to position the elevator's first card support for continuing the randomization operation after discharge of the one faulty card to the second discharge portal.

2. The card handling device of claim 1 whereupon unshuffled cards may reside simultaneously within the input portal while one faulty card is being discharged to the second discharge portal.

3. The card handling device of claim 1 further comprising the first card support consisting of a single platform and the second card support consisting of a rotatable fork.

4. The card handling device of claim 1 further comprising the first card support consisting of a single platform and the second card support consisting of a non-rotatable fork.

5. The card handling device of claim 1 whereupon individual cards are removed from the elevator by centrifugal force.

6. The card handling device of claim 1 further comprising a mechanized arm for removing individual cards from the elevator.

7. The card handling device of claim 1 further comprising a gripper mechanism located in the randomizing chamber.

8. The card handling device of claim 1, wherein a rotatable fork is actuated by the elevator movement.

9. A card handling device for randomizing and/or verifying integrity of a group of cards, the card handling device comprising:

a housing:

a card intake portal accessible by the device operator for receiving unshuffled cards to be randomized;

a first discharge portal accessible by a device operator for receiving randomized and properly verified card stacks from within the card handling device;

a second discharge portal visibly and physically accessible by a device operator for receiving faulty cards one at a time from within the card handling device;

a control panel for indicating a status of a stack of cards;

an optical recognition sensor configured to interrogate an identity of each card from within the unshuffled cards of the card intake portal;

at least one microcontroller configured to separate the faulty cards;

the at least one microcontroller directing movement of an elevator after deciding upon a destination for each interrogated card;

a randomizing chamber for randomizing the order of a group of cards;

a card transport path for moving individual cards from the optical recognition sensor into the randomizing chamber;

the elevator having a platform movable within the randomizing chamber to align with the card transport path for receiving properly verified cards;

wherein the elevator is moved to prevent alignment of the platform with the card transport path when a faulty card is identified;

wherein a faulty card is disgorged into the randomizing chamber and moved to the second discharge portal solely by gravity; and wherein the at least one microcontroller is configured to reposition the elevator platform for continuing the randomizing after discharge of the faulty card to the second discharge portal.

10. The card handling device of claim 9 wherein the second discharge portal extends from the randomizing chamber.

* * * * *